US009839266B2

(12) United States Patent
Gray et al.

(10) Patent No.: US 9,839,266 B2
(45) Date of Patent: Dec. 12, 2017

(54) COMPONENT WITH GRIPPING ELEMENT

(71) Applicants: Pandora A/S, Glostrup (DK); Pandora Production Co., Ltd., Bangkok (TH)

(72) Inventors: Lee Antony Gray, København Ø (DK); Jean-Pierre Selbe, Bangkok (TH); Weerasak Wannachai, Bangkok (TH)

(73) Assignees: Pandora A/S, Glostrup (DK); Pandora Production Co., Ltd., Bangkok (TH)

( * ) Notice: Subject to any disclaimer, the term of this patent is extended or adjusted under 35 U.S.C. 154(b) by 359 days.

(21) Appl. No.: 14/585,042

(22) Filed: Dec. 29, 2014

(65) Prior Publication Data

US 2015/0114039 A1 Apr. 30, 2015

Related U.S. Application Data

(63) Continuation of application No. 14/146,893, filed on Jan. 3, 2014, now Pat. No. 8,950,214.

(Continued)

(30) Foreign Application Priority Data

Feb. 11, 2013 (EP) ..... 13154843

(51) Int. Cl.

*A44C 15/00* (2006.01)
*A44C 25/00* (2006.01)

(Continued)

(52) U.S. Cl.

CPC ..... *A44C 25/00* (2013.01); *A44C 5/00* (2013.01); *A44C 11/00* (2013.01); *A44C 11/002* (2013.01);

(Continued)

(58) Field of Classification Search

CPC ... A44C 13/00; A44C 17/0208; A44C 25/007; A44C 17/0216; A44C 17/0225;

(Continued)

(56) References Cited

U.S. PATENT DOCUMENTS 1,124,518 A 1/1915 Qvarnstrom
1,176,631 A 3/1916 Wells (Continued)

FOREIGN PATENT DOCUMENTS

AU 2009100851 A4 10/2009
CN 1879519 A 12/2006

(Continued)

OTHER PUBLICATIONS

European Patent Application 13154843.0 European Search Report and Opinion dated Jul. 3, 2013.

(Continued)

*Primary Examiner* — Jack W Lavinder
(74) *Attorney, Agent, or Firm* — Fox Rothschild LLP; Carol E. Thorstad-Forsyth

(57) ABSTRACT

In one embodiment, an ornamental component is provided for use with jewelry (a bracelet or necklace). The ornamental component has a through hole allowing the ornamental component to be strung on an elongated member of the jewelry. The ornamental component includes a self-supporting housing and an insert assembly. The housing has a through hole with first and second openings at first and second sides, respectively, of the housing. The insert assembly is inserted in the through hole of the housing, and the insert assembly is assembled from a first tubular element and a gripping element. The first tubular element has a through hole that forms at least a part of the ornamental component through hole. The gripping element is configured to frictionally grip a part of the jewelry item. The first tubular (Continued)

element is configured to secure the gripping element inside the through hole of the ornamental component.

18 Claims, 12 Drawing Sheets

Related U.S. Application Data

(60) Provisional application No. 61/763,251, filed on Feb. 11, 2013.

(51) Int. Cl.
*A44C 11/00* (2006.01)
*A44C 5/00* (2006.01)
*A44C 27/00* (2006.01)

(52) U.S. Cl.
CPC ..... *A44C 15/005* (2013.01); *A44C 27/00* (2013.01); *Y10T 24/39* (2015.01); *Y10T 29/4959* (2015.01); *Y10T 29/49591* (2015.01)

(58) Field of Classification Search
CPC ..... A44C 17/0258; A44C 11/002; A41C 17/0241; Y10T 29/4959; Y10T 29/49595; Y10T 29/49798; Y10T 29/49927; Y10T 29/49588
USPC ..... 63/23, 29.1, 31, 21, 38; 29/896.41; 24/712.7, 115 A, 115 R
See application file for complete search history.

(56) References Cited

U.S. PATENT DOCUMENTS

| | | | |
|---|---|---|---|
| 1,510,421 | A | 9/1924 | Shermna |
| 1,746,054 | A | 2/1930 | Ridabock |
| 2,462,425 | A | 2/1949 | Pratt et al. |
| 2,521,589 | A | 9/1950 | Liningston |
| 2,714,269 | A | 8/1955 | Stafford et al. |
| 2,861,313 | A | 11/1958 | Ruf |
| 2,942,318 | A | 6/1960 | Charles |
| 2,947,053 | A | 8/1960 | Sanderson |
| 3,066,501 | A | 12/1962 | Charles et al. |
| 3,481,155 | A | 12/1969 | Cook |
| 3,983,716 | A | 10/1976 | Kuhn |
| 4,237,702 | A | 12/1980 | Caverly |
| 4,246,679 | A | 1/1981 | Monett |
| 4,286,360 | A | 9/1981 | Skobel |
| 4,321,804 | A | 3/1982 | Borofsky et al. |
| 4,377,078 | A | 3/1983 | Block |
| 4,393,552 | A | 7/1983 | Frankel |
| 4,494,279 | A | 1/1985 | Kilguss |
| 4,530,221 | A | 7/1985 | Weinberg |
| 4,562,704 | A | 1/1986 | Benedek et al. |
| 4,590,649 | A | 5/1986 | Neilson, Jr. |
| 4,754,534 | A | 7/1988 | Helwick |
| 4,907,322 | A | 3/1990 | Kanno |
| 5,123,645 | A | 6/1992 | MacDonald et al. |
| 5,279,132 | A | 1/1994 | Swaim |
| 5,398,391 | A | 3/1995 | Yokochi |
| 5,440,900 | A | 8/1995 | White |
| 5,588,190 | A | 12/1996 | Sato |
| 5,881,736 | A | 3/1999 | Turner et al. |
| 6,109,999 | A | 8/2000 | Kuo |
| 6,357,261 | B1 | 3/2002 | Cheng |
| 6,449,810 | B1 | 9/2002 | Kuwayama |
| 6,470,571 | B1 | 10/2002 | Namiki |
| 6,557,376 | B2 | 5/2003 | Pratt |
| 6,675,611 | B2 | 1/2004 | Hunter |
| 6,698,238 | B1 | 3/2004 | Cheng |
| 7,007,507 | B2 | 3/2006 | Evevoldsen |
| 7,472,564 | B2 * | 1/2009 | Bolzt ..... A44C 15/005 63/26 |
| 2002/0139141 | A1 | 10/2002 | Kuwayama |
| 2002/0148250 | A1 | 10/2002 | Pratt |
| 2003/0154742 | A1 | 8/2003 | Ooide |
| 2004/0144131 | A1 | 7/2004 | Enevoldsen |
| 2006/0117795 | A1 | 6/2006 | Enevoldsen |
| 2006/0260300 | A1 | 11/2006 | Julkowski et al. |
| 2006/0277945 | A1 | 12/2006 | Bolzt et al. |
| 2007/0000283 | A1 | 1/2007 | Murao et al. |
| 2012/0111053 | A1 | 5/2012 | Huynh |

FOREIGN PATENT DOCUMENTS

| | | | |
|---|---|---|---|
| DE | 3028470 | A1 | 3/1982 |
| DE | 20021250 | U1 | 1/2002 |
| EP | 0799587 | A1 | 7/2000 |
| EP | 1080653 | A2 | 7/2011 |
| GB | 243226 | A | 11/1925 |
| GB | 784877 | | 10/1957 |
| GB | 797704 | | 7/1958 |
| GB | 807655 | | 1/1959 |
| GB | 812568 | | 4/1959 |
| GB | 833700 | | 4/1960 |
| GB | 848083 | | 9/1960 |
| GB | 848932 | | 9/1960 |
| GB | 851834 | | 10/1960 |
| GB | 854666 | | 11/1960 |
| JP | H1146826 | | 2/1999 |
| JP | 3063739 | | 11/1999 |
| JP | 2000050921 | | 2/2000 |
| JP | 200016623 | | 6/2000 |
| JP | 2000225009 | | 8/2000 |
| JP | 2001120315 | | 5/2001 |
| JP | 3384558 | | 12/2002 |
| JP | 336651 | | 1/2003 |
| JP | 2005143851 | A | 6/2005 |
| KR | 19880002101 | | 6/1988 |
| KR | 199003997 | | 6/1990 |
| WO | 0205677 | A1 | 1/2002 |
| WO | 2006125155 | A1 | 11/2006 |

OTHER PUBLICATIONS

Machine translation of DE3028470, retrieved Jun. 24, 2014.
Office Action in related Australian Pat. App. No. 2013257507, dated Jan. 24, 2014.

* cited by examiner

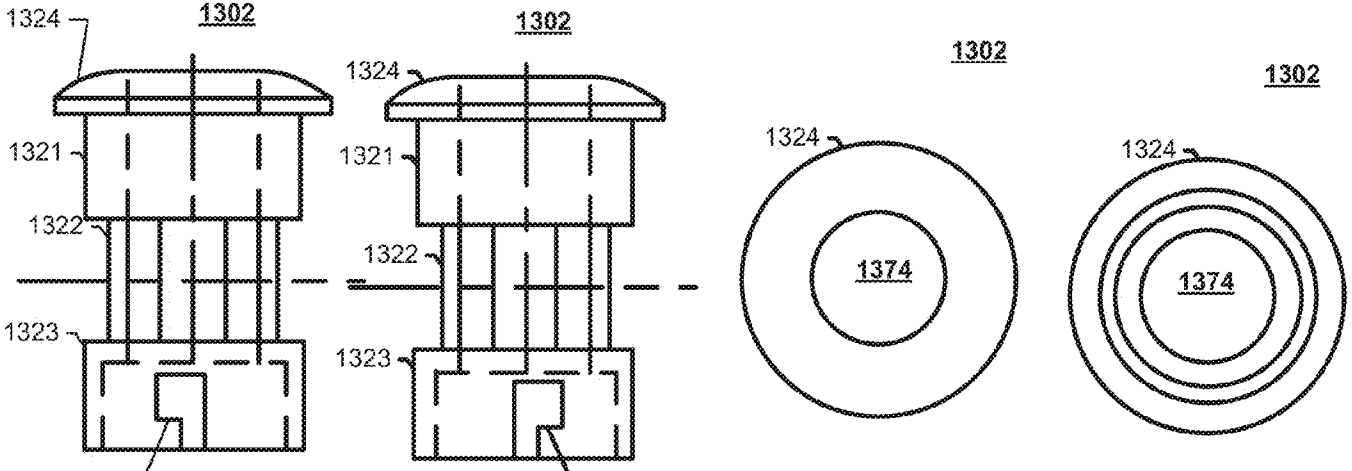
Fig. 13a
Fig. 13b
Fig. 13c
Fig. 13d
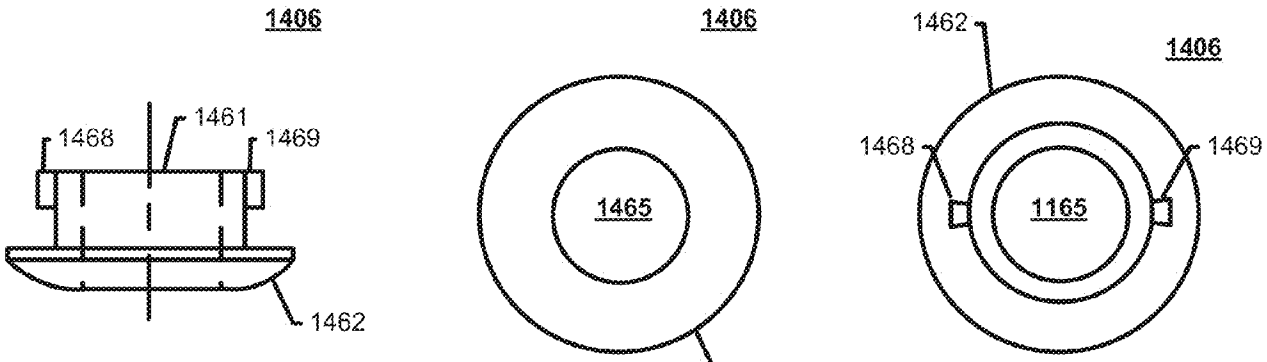
Fig. 14a
Fig. 14b
Fig. 14c

COMPONENT WITH GRIPPING ELEMENT

RELATED APPLICATIONS

This application is a continuation of U.S. patent application Ser. No. 14/146,893, filed Jan. 3, 2014 and titled "Ornamental Component With Gripping Element" which claims priority to U.S. provisional patent application 61/763,251 filed Feb. 11, 2013 and titled "Ornamental Component With Gripping Element", and to European patent application EP 13154843 filed Feb. 11, 2013 and titled "Ornamental Component With Gripping Element". The disclosure of each is incorporated herein in its entirety by reference, and priority to each is claimed.

FIELD

The present invention relates to an ornamental component for a bracelet or necklace, to a bracelet or necklace comprising such an ornamental component, to a method of manufacturing an ornamental component, and a tubular element for securing a gripping element inside a through hole of an ornamental component.

BACKGROUND

Jewelry, such as necklaces and bracelets, often consists of a plurality of freely movable ornamental components (e.g., beads) strung on an elongated member (e.g., chain, wire, or string). To prevent all the freely movable beads from grouping together at the bottom of the necklace or bracelet, an ornamental component provided with a stopping mechanism configured to grip the necklace or bracelet may be used. Such stopping mechanisms are known from the prior art in a variety of forms.

An example of a prior art variation of a stopping mechanism is disclosed in US 2003/0154742, in which a jewel is produced with an elastic body inside configured to provide a frictional force on an elongated member. A similar solution is disclosed in US 2002/0148250, in which the jewel itself is provided with a flexible resilient tube with an inside diameter slightly smaller than the outer diameter of an elongated member, as to fix the jewel on the elongated member.

Another prior art variation is disclosed in WO 2006/125155.

It may, however, be difficult to produce such prior art ornamental components. Additionally, the stopping mechanisms may be vulnerable to damage.

Thus, it remains a problem to provide a robust ornamental component provided with a stopping mechanism that can be easily manufactured.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In one embodiment, an ornamental component is provided for use with a jewelry item (i.e., a bracelet or a necklace). The ornamental component has a through hole with a through hole axis, and the through hole allows the ornamental component to be strung on an elongated member of the jewelry item. The ornamental component includes a self-supporting housing and an insert assembly. The self-supporting housing has a through hole with a first opening at a first side of the self-supporting housing and a second opening at a second side of the self-supporting housing. The insert assembly is inserted in the through hole of the self-supporting housing, and the insert assembly is assembled from a first tubular element and a gripping element. The first tubular element has a through hole that forms at least a part of the ornamental component through hole. The gripping element is configured to frictionally grip a part of the jewelry item. The first tubular element is configured to secure the gripping element inside the through hole of the ornamental component.

In another embodiment, a jewelry item (i.e., a bracelet or a necklace) includes an elongated member and a first ornamental component having a through hole with a through hole axis. The ornamental component is strung on the elongated member via the through hole. The ornamental component includes: (a) a self-supporting housing having a through hole with a first opening at a first side of the self-supporting housing and a second opening at a second side of the self-supporting housing; and (b) an insert assembly inserted in the through hole of the self-supporting housing. The insert assembly is assembled from a first tubular element and a gripping element. The first tubular element has a through hole that forms at least a part of the ornamental component through hole, and the gripping element frictionally grips a part of the jewelry item. The first tubular element is configured to secure the gripping element inside the through hole of the ornamental component. The first ornamental component is configured so that the gripping element resiliently grips the elongated member to fix the first ornamental component along the elongated member until a particular force is acting on the first ornamental component, whereby the first ornamental component can be moved along the elongated member.

In still another embodiment, a method for manufacturing an ornamental component is provided. The ornamental component has a through hole allowing the ornamental component to be strung on an elongated member of a jewelry item (i.e., a bracelet or a necklace), and the through hole defines a through hole axis. The method includes the steps: (a) providing a self-supporting housing having a through hole, wherein the self-supporting housing through hole comprises a first opening at a first side of the self-supporting housing and a second opening at a second side of the self-supporting housing; (b) assembling an insert assembly having a first tubular element and a gripping element, the first tubular element having a through hole that at least partly forms the through hole of the ornamental component, the gripping element being configured for frictionally gripping the elongated member of the jewelry item; and (c) inserting the insert assembly in the through hole of the self-supporting housing.

In yet another embodiment, an ornamental component for a jewelry item (i.e., a bracelet or a necklace) is provided. The ornamental component has a through hole allowing the ornamental component to be strung on an elongated member of the jewelry item, and the ornamental component through hole defines a through hole axis. The ornamental component further includes a self-supporting housing and an insert assembly. The self-supporting housing has a through hole with a first opening at a first side of the self-supporting housing and a second opening at a second side of the self-supporting housing. The insert assembly is inserted in the through hole of the self-supporting housing, and the insert assembly includes a first tubular element and a gripping element. The first tubular element has a through hole that forms at least a part of the through hole of the ornamental component, and the gripping element is configured for frictionally gripping a part of the jewelry item. The first tubular element is further configured to secure the gripping element inside the through hole of the ornamental component, and the first tubular element has a first circumferential opening extending along the through hole axis. The gripping element has a first gripping portion for frictionally gripping the elongated member of the jewelry item, and the first gripping portion extends through the first circumferential opening.

BRIEF DESCRIPTION OF THE DRAWINGS

FIGS. 13*a-d* show a first tubular element according to an embodiment of the present invention.

FIG. 14*a-c* show a locking element according to an embodiment of the present invention.

DETAILED DESCRIPTION

Figure 1A:
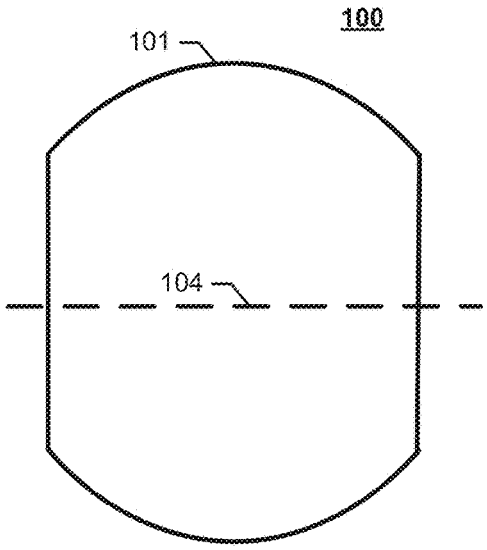
FIGS. 1*a-c* show an ornamental component according to an embodiment of the present invention.

According to a first aspect, the invention relates to an ornamental component for a bracelet and/or a necklace. The ornamental component has a through hole allowing the ornamental component to be strung on an elongated member of a bracelet and/or necklace, and the through hole defines a through hole axis. The ornamental component includes: (a) a self-supporting housing having a through hole comprising a first opening at a first side of the self-supporting housing and a second opening at a second side of the self-supporting housing; and (b) an insert assembly inserted in the through hole of the self-supporting housing. The insert assembly is assembled from a first tubular element having a through hole that forms at least a part of the through hole of the ornamental component and a gripping element for frictionally gripping a part of the bracelet and/or necklace, and the first tubular element is configured to secure the gripping element inside the through hole of the ornamental component.

Consequently, by using an insert assembly to provide an ornamental component with a gripping element, the production costs may be lowered. Additionally, by using a tubular element to secure the gripping element inside the self-supporting housing, the gripping element may be more efficiently protected from damage.

An ornamental component may be any component that can be strung on a bracelet and/or necklace for ornamental purposes such as a bead. An ornamental component according to the first aspect of the invention may be used to organize freely movable beads on a bracelet or necklace. For example, two ornamental components may be pulled to a desired position on an elongated member of a bracelet or necklace and released, whereby they resiliently grip the elongated member. Consequently (in this example), the bracelet or necklace is divided into three distinct zones for freely movable beads. This may be used to prevent all the freely movable beads from grouping together.

The self-supporting housing may constitute the outer surface of the ornamental component or may be covered with another layer or element constituting the outer surface of the ornamental component. The self-supporting housing may have any shape such as approximately spherical, cylindrical or cubical. The self-supporting housing has a structural strength allowing it to be securely handled during the manufacturing process of the ornamental component. The self-supporting housing may provide the primary structural strength of the ornamental component. The self-supporting housing may be made of metal, glass, wood, plastic or a combination thereof. The trough hole of the self-supporting housing may have a constant width or may have a varying width (measured in planes being perpendicular to the through hole axis). For example, the through hole of the self-supporting housing may be wider in the central part of self-supporting housing than at the first opening and the second opening. The inner surface of the through hole of the self-supporting housing may be spaced apart from the insert assembly by another element or a fluid e.g. air. At least a part of the self-supporting housing may be transparent or semi-transparent.

The individual element of the insert assembly may be permanently attached or non-permanently attached. The insert assembly may be inserted into the through hole of the housing through the first opening of the housing, i.e. the insert assembly may have a size and shape allowing it to be insertable through the first opening of the self-supporting housing.

The first tubular element may have any outer shape such as round or rectangular. Correspondingly, the through hole of the first tubular element may have any shape such as round or rectangular. The first tubular element may be integrally molded, i.e. made from a single mold. The first tubular element may be made of metal and/or plastic.

The gripping element may be made of a material configured to establish a high frictional connection with an elongated member of a bracelet and/or necklace, e.g. a chain, band, or strand of a necklace or bracelet. The gripping element may be made of a deformable material such as a silicone material.

In some embodiments, the gripping element is made of a first material and the first tubular element is made of a second material, wherein the coefficient of friction of the first material is higher than the coefficient of friction of the second material relative to sterling silver.

The coefficient of friction of the first material may be at least 10%, 20%, 40% or 60% higher than the coefficient of friction of the second material relative to sterling silver.

In some embodiments of the invention, the gripping element is positioned in a central part of the ornamental component and have a width along the through hole axis of less than 95%, 90%, 80%, 70%, 60% or 50% of the width of the self-supporting housing along the through hole axis.

Consequently, the gripping element is better protected. Thus, a more robust ornamental component is provided.

In some embodiments, the first tubular element comprises a first circumferential opening extending along the through hole axis, and the gripping element comprises a first gripping portion for frictionally gripping the elongated member of the bracelet and/or necklace, with the first gripping part extending through the first circumferential opening.

In some embodiments, the gripping element comprises a tubular portion, and the first gripping portion protrudes from an interior surface of the tubular portion. Further, the tubular portion of the gripping element surrounds a part of the first tubular element.

Consequently, the tubular element may in an efficient manner secure the gripping element inside the through hole of the ornamental component.

The entire gripping element may be integrally molded, i.e. made from a single mold.

In some embodiments, the first tubular element comprises a second circumferential opening extending along the through hole axis and the gripping element comprises a second gripping portion protruding from an interior surface of the tubular portion of the gripping element, with the second gripping portion extending through the second circumferential opening.

In some embodiments, the first tubular element comprises a third circumferential opening extending along the through hole axis and the gripping element comprises a third gripping portion protruding from an interior surface of the tubular portion of the gripping element, with the third gripping portion extending through the third circumferential opening.

In some embodiments, the first circumferential opening, the second circumferential opening and/or the third circumferential opening have a width along the through hole axis of less than 95%, 90%, 80%, 70%, 60% or 50% of the width of the first tubular element along the through hole axis.

In some embodiments, each of the first circumferential opening, the second circumferential opening and/or the third circumferential opening extends between 5% and 33% of the circumference of the first tubular element in a plane being perpendicular to the through hole axis.

In some embodiments, the first tubular element comprises a first portion and a second portion, wherein the second portion has a lower widest width than the widest width of the first portion. The tubular portion of the gripping element is arranged to fit snugly around the second portion of the first tubular element, and abut the first portion of the first tubular element whereby the gripping element is prevented from moving in a first direction along the through hole axis relative to the first tubular element.

In some embodiments, the first tubular element further comprises a third portion, and the second portion has a lower widest width than the widest width of the first portion and the third portion. The tubular portion of the gripping element further abuts the third portion of the first tubular element thereby preventing the gripping element from moving in any direction along the through hole axis relative to the first tubular element.

The widest width is measured in a plane being perpendicular to the through hole axis.

In some embodiments, the tubular portion of the gripping element has a widest width approximately equal to the widest width of the first portion and/or third portion of the first tubular element.

In some embodiments, the ornamental component further comprises a second tubular element, and the first tubular element is positioned inside the second tubular element.

This may make it easier to insert the insert assembly into the self-supporting housing. The second tubular element may additionally hide non-decorative elements of the ornamental component, when the self-supporting housing is transparent or semi-transparent.

The second tubular element may have a width along the through hole axis being approximately equal to the width of the self-supporting housing. The second tubular element may be fully inserted into the through hole of the self-supporting housing.

In some embodiments, the first tubular element of the insert assembly at a first end further comprises a collar, with the collar being positioned outside the self-supporting housing at the first opening of the self-supporting housing. The collar includes a surface abutting an outer surface of the self-supporting housing, thereby preventing the first tubular element of the insert assembly from moving in a first direction along the through hole axis relative to the ornamental component.

The outer surface may be an outer surface of the self-supporting housing. The collar may be an integral portion of the first tubular element or may be attached to the first tubular element.

In some embodiments, the ornamental component further comprises a locking element having a through hole wherein the locking element comprises an engagement portion positioned inside the self-supporting housing and a collar positioned outside the self-supporting housing at the second opening of the self-supporting housing. The engagement portion is attached to the first tubular element and the collar comprises a surface abutting an outer surface of the self-supporting housing, thereby preventing the first tubular element of the insert assembly from moving in a second direction along the through hole axis relative to the ornamental component.

Consequently, the insert assembly is in an effective manner secured to the self-supporting housing.

The outer surface may be an outer surface of the self-supporting housing.

The engagement portion and the collar of the locking element may be integrally formed. The locking element may be attached to the first tubular element by the use of glue or a mechanical locking mechanism.

In some embodiments, the engagement part of the locking element is inserted into the first tubular element whereby the through hole of the locking element and the through hole of the first tubular element together forms the through hole of the ornamental component.

In some embodiments, the engagement portion is attached to the first tubular element by a male/female locking mechanism, wherein the male part comprises a protruding portion and the female part comprises a recess and/or opening.

The engagement portion may be the male part and the first tubular element may be the female part, i.e. the engagement portion may comprise a protruding portion configured to engage with recess and/or opening in the first tubular element. Alternatively, the first tubular element may be the male part and the engagement portion may be the female part.

In some embodiments, the male/female locking mechanism is of the snap lock type wherein a translation and/or rotation from a free rotational orientation and/or position of the male and female part to a locked rotational orientation and/or position of the male and female part requires less force than a translation and/or rotation from a locked rotational orientation and/or position of the male and female part to a free rotational orientation and/or position of the male and female part.

This may be beneficial as the locking element and the first tubular element typically are permanently attached.

In some embodiments, the male/female locking mechanism may be of the rotational lock type, wherein the female part (the engagement portion or the first tubular element) comprises a recess and/or opening configured to allow the protruding portion of the male part to translate inside the recess and/or opening along the through hole axis when the locking element is in a free rotational orientation relative to the first tubular element, and to be prevented from moving in at least a first direction along the through hole axis when the locking element is in a locked position relative to the first tubular element and the locking element is in a locked rotational orientation relative to the first tubular element.

In some embodiments, the male part comprises a plurality of protruding portions and the female part comprises a plurality of recess and/or openings.

When the male/female locking mechanism is of the rotational type the locking element may be attached to the first tubular element by firstly rotationally orienting the locking element in the free rotational orientation relative to the first tubular element, next translating the first tubular element and/or the locking element along the through hole axis until the locking element is in the locked position relative to the first tubular element, and finally rotating the first tubular element and/or the locking element from the free rotational orientation to the locked rotational orientation.

The protruding portion of the male part and/or the recess and/or opening of the female part may be configured so that a rotation from the free rotational orientation to the locked rotational orientation requires less force than a rotation from the locked rotational orientation to the free rotational orientation.

In some embodiments, the male part (the engagement portion or the first tubular element) comprises a flexible member configured to deform from a first shape to a second shape when the male part comes into contact with the female part, and further to snap back into approximately the first shape when the flexible member is aligned with the recess and/or opening of the female part, whereby the flexible member engages with the recess and/or opening and locks the male part to the female part, allowing the locking element to be attached to the first tubular element by a pure translation between the two.

In some embodiments, the male part comprises two flexible members, and the female part comprises two recesses and/or openings.

The two flexible members may be arranged at opposite sides of the male part. Correspondingly, the two recesses and/or openings may be arranged at opposite sides of the female part.

In some embodiments, the ornamental component has a length along the through hole axis between 2 mm and 5 cm.

In some embodiments, the first tubular element comprises a fourth circumferential opening extending along the through hole axis and the gripping element comprises a fourth gripping portion protruding from an interior surface of the tubular portion of the gripping element, with the fourth gripping portion extending through the fourth circumferential opening.

According to a second aspect, the invention relates to a bracelet or a necklace having: an elongated member and a first ornamental component as disclosed in relation to the first aspect of the invention, strung on the elongated member. The first ornamental component is configured so that the gripping element resiliently grips the elongated member to fix the first ornamental component along the elongated member until a particular force is acting on the first ornamental component, whereby the first ornamental component can be moved along the elongated member.

The elongated member may be any elongated member suitable for jewelry such as a metal chain, leather string, a fabric string, or an anchor type chain.

In some embodiments, the particular force is higher than the maximum gravitational force gravity acting on the ornamental component.

In some embodiments, the bracelet or necklace further comprises at least one freely movable ornamental component strung on the elongated member.

In some embodiments, the bracelet or necklace further comprises a plurality of freely movable ornamental components strung on the elongated member.

In some embodiments, the bracelet or necklace further comprises a second ornamental component as disclosed in relation to the first aspect of the invention strung on the elongated member. The second ornamental component is configured so that the gripping element resiliently grips the elongated member to fix the second ornamental component along the elongated member until a particular force is acting on the second ornamental component, whereby the second ornamental component can be moved along the elongated member.

According to a third aspect, the invention relates to a method for manufacturing an ornamental component that has a through hole allowing the ornamental component to be strung on an elongated member of a bracelet and/or necklace, with the through hole defining a through hole axis. The method includes the steps: (a) providing a self-supporting housing, having a through hole, wherein the through hole comprises a first opening at a first side of the self-supporting housing and a second opening at a second side of the self-supporting housing; (b) assembling an insert assembly comprising a first tubular element having a through hole that at least partly forms the through hole of the ornamental component, and a gripping element for frictionally gripping the elongated member of a bracelet and/or a necklace; and (c) inserting the insert assembly in the through hole of the housing.

Consequently, an efficient method of producing an ornamental component comprising a gripping element is provided.

In some embodiments, the insert assembly is inserted in the through hole of the self-supporting housing through the first opening of the self-supporting housing.

In some embodiments, the ornamental component is an ornamental component as disclosed in relation to the first aspect of the invention.

In some embodiments, the insert assembly is assembled before it is inserted into the through hole of the self-supporting housing.

In some embodiments, the first tubular element comprises a first circumferential opening extending along the through hole axis, with the gripping element having a first gripping portion for frictionally gripping the elongated member of the bracelet and/or necklace and a tubular portion. The first gripping portion protrudes from an inner surface of the tubular portion, and the step of assembling the insert assembly includes pulling the gripping element around the first tubular element until the first gripping portion is aligned with the first circumferential opening, whereby the first gripping portion extends through the first circumferential opening and a part of the inner surface of the tubular portion rests upon a part of the outer surface of the first tubular element thereby securing the gripping element to the first tubular element.

In some embodiments, the first tubular element further comprises a second circumferential opening extending along the through hole axis, and the gripping element further comprises a second gripping portion for frictionally gripping the elongated member of the bracelet and/or necklace, with the second gripping portion protruding from an inner surface of the tubular portion. Here, the step of assembling the insert assembly comprises pulling the gripping element around the first tubular element until the first gripping portion is aligned with the first circumferential opening and the second gripping portion is aligned with the second circumferential opening, whereby the first gripping portion extends through the first circumferential opening, the second gripping portion extends through the second circumferential opening, and a part of the inner surface of the tubular portion rests upon a part of the outer surface of the first tubular element thereby attaching the gripping element to the first tubular element.

In some embodiments, the first tubular element further comprises a third circumferential opening extending along the through hole axis, and the gripping element further comprises a third gripping portion for frictionally gripping the elongated member of the bracelet and/or necklace. The third gripping portion protrudes from an inner surface of the tubular portion, and the step of assembling the insert assembly comprises pulling the gripping element around the first tubular element until the first gripping portion is aligned with the first circumferential opening, the second gripping portion is aligned with the second circumferential opening, and the third gripping portion is aligned with the third circumferential opening, whereby the first gripping portion extends through the first circumferential opening, the second gripping portion extends through the second circumferential opening, the third gripping portion extends through the third circumferential opening, and a part of the inner surface of the tubular portion rests upon a part of the outer surface of the first tubular element thereby attaching the gripping element to the first tubular element.

In some embodiments, the ornamental component further comprises a locking element having a through hole, an engagement part for engaging with the insert assembly, and a collar for being positioned outside the self-supporting housing. A method of using this embodiment includes the steps: (a) inserting the engagement part of the locking element into the second opening of the self-supporting housing; and (b) attaching the engagement part to the insert assembly.

In some embodiments, the engagement part is attached to the insert assembly by a male/female locking mechanism.

According to a fourth aspect, the invention relates to a tubular element for securing a griping element for gripping an elongated member of a bracelet and/necklace in a through hole of an ornamental component. The tubular element has a through hole defining a tubular element through hole axis, and the tubular element comprises a first circumferential opening extending along the tubular element through hole axis for receiving a first gripping portion of the gripping element allowing the first gripping portion to extend through the first circumferential opening.

In some embodiments, the tubular element further comprises a second circumferential opening extending along the tubular element through hole axis for receiving a second gripping portion of the gripping element allowing the second gripping portion to extend through the second circumferential opening.

In some embodiments, the tubular element further comprises a third circumferential opening extending along the tubular element through hole axis for receiving a third gripping portion of the gripping element allowing the third gripping portion to extend through the third circumferential opening.

In some embodiments, the first circumferential opening, the second circumferential opening, and/or the third circumferential opening have a width along the tubular element through hole axis of less than 95%, 90%, 80%, 70%, 60%, or 50% of the width of the tubular element along the tubular element through hole axis.

In some embodiments, each of the first circumferential opening, the second circumferential opening, and/or the third circumferential opening extends between 5% and 33% of the circumference of the tubular element in a plane being perpendicular to the tubular element through hole axis.

In some embodiments, the tubular element is insertable in a through hole of a self-supporting housing of the ornamental component through a first opening of the through hole of the self-supporting housing.

In some embodiments, the tubular element comprises a first portion and a second portion, with the first portion being positioned next to the second portion. The second portion has a lower widest width than the widest width of the first portion measured in a plane being perpendicular to the tubular element through hole axis, and the first circumferential opening is positioned at the second portion of the tubular element.

In some embodiments, the second circumferential opening is positioned at the second portion of the tubular element.

In some embodiments, the third circumferential opening is positioned at the second portion of the tubular element.

In some embodiments, the tubular element further comprises a third portion positioned next to the second portion, and the second portion has a lower widest width than the widest width of the first portion and the third portion, measured in a plane being perpendicular to the tubular element through hole axis.

In some embodiments, the first circumferential opening extends approximately the entire length, along the tubular element through hole axis, of the second portion of the tubular element.

In some embodiments, the second circumferential opening extends approximately the entire length, along the tubular element through hole axis, of the second portion of the tubular element.

In some embodiments, the third circumferential opening extends approximately the entire length, along the tubular element through hole axis, of the second portion of the tubular element.

In some embodiments, the tubular element further comprises a collar for being positioned outside the self-supporting housing. The collar includes a surface for abutting an outer surface of the self-supporting housing for preventing the tubular element from moving in a first direction along the tubular element through hole axis relative to the self-supporting housing.

The collar may be an integral portion of the first tubular element or may be attached to the first tubular element. The collar may be arranged at a first opening of the through hole of the tubular element.

In some embodiments, the engagement portion is attached to the first tubular element by a male/female locking mechanism, with the male part comprising a protruding portion and the female part comprising a recess and/or opening.

The engagement portion may be the male part, and the first tubular element may be the female part (i.e., the engagement portion may comprise a protruding portion configured to engage with recess and/or opening in the first tubular element). Alternatively, the first tubular element may be the male part, and the engagement portion may be the female part.

In some embodiments, the male/female locking mechanism is of the snap lock type wherein a translation and/or rotation from a free rotational orientation and/or position of the male and female part to a locked rotational orientation and/or position of the male and female part requires less force than a translation and/or rotation from a locked rotational orientation and/or position of the male and female part to a free rotational orientation and/or position of the male and female part.

This may be beneficial as the locking element and the first tubular element typically are permanently attached.

In some embodiments, the male/female locking mechanism may be of the rotational lock type, wherein the female part (locking element or the tubular element) comprises a recess and/or opening configured to allow the protruding portion of the male part to translate inside the recess and/or opening along the tubular element through hole axis when the locking element is in a free rotational orientation relative to the first tubular element, and to be prevented from moving in at least a first direction along the tubular element through hole axis when the locking element is in a locked position relative to the first tubular element and the locking element is in a locked rotational orientation relative to the first tubular element.

In some embodiments, the male part comprises a plurality of protruding portions and the female part comprises a plurality of recesses and/or openings.

The protruding portion of the male part and/or the recess and/or opening of the female part may be configured so that a rotation from the free rotational orientation to the locked rotational orientation requires less force than a rotation from the locked rotational orientation to the free rotational orientation.

In some embodiments, the tubular element has a length along the tubular element through hole axis between 2 mm and 3 cm.

According to a fifth aspect, the invention relates to an ornamental component for a bracelet and/or a necklace. The ornamental component has a through hole allowing the ornamental component to be strung on an elongated member of a bracelet and/or necklace, and the through hole defines a through hole axis. The ornamental component further includes: (a) a self-supporting housing having a through hole comprising a first opening at a first side of the housing and a second opening at a second side of the housing; (b) a first tubular element having a through hole inserted in the through hole of the self-supporting housing through the first opening of the self-supporting housing; and (c) a locking element having a through hole inserted in the through hole of self-supporting housing through the second opening of the self-supporting housing. The locking element comprises a engagement portion attached to the first tubular element.

Consequently, by providing an ornamental component with a lining by using two parts inserted from two sides of the ornamental component, the lining (the first tubular element and the locking element) may be attached to the bead without deforming it. This allows more complex insert elements to be used such as pre decorated linings and lining composed of a plurality of elements.

An ornamental component may be any component that can be strung on a bracelet and/or necklace for ornamental purposes such as a bead. An ornamental component according to the fifth aspect of the invention may be an freely movable ornamental component or an ornamental component used to organize freely movable beads on a bracelet or necklace. The self-supporting housing may constitute the outer surface of the ornamental component or may be covered with another layer or element constituting the outer surface of the ornamental component. The self supporting housing may have any shape such as approximately spherical, cylindrical or cubical. The self-supporting housing has a structural strength allowing it to be securely handled during the manufacturing process of the ornamental component. The self-supporting housing may provide the primary structural strength of the ornamental component. The self-supporting housing may be made of metal, glass, wood, plastic or a combination thereof. The through hole of the self-supporting housing may have a constant width or may have a varying width (measured in planes being perpendicular to the through hole axis). For example, the through hole of the self-supporting housing may be wider in the central part of self-supporting housing than at the first opening and the second opening. The inner surface of the through hole of the self-supporting housing may be spaced apart from the insert assembly by another element or a fluid (e.g., air). At least a part of the self-supporting housing may be transparent or semi-transparent.

The engagement portion and the first tubular element may be permanently attached or non-permanently attached.

The first tubular element may have any outer shape such as round or rectangular. Correspondingly, the through hole of the first tubular element may have any shape such as round or rectangular. The first tubular element may be integrally molded (i.e., made from a single mold). The first tubular element may be made of metal and/or plastic.

The engagement portion of the locking element may be attached to the first tubular element by the use of an adhesive or a mechanical locking mechanism.

In some embodiments, the engagement portion is attached to the first tubular element by a male/female locking mechanism, wherein the male part comprises a protruding portion and the female part comprises a recess and/or opening.

The engagement portion may be the male part, and the first tubular element may be the female part (i.e., the engagement portion may comprise a protruding portion configured to engage with recess and/or opening in the first tubular element). Alternatively, the first tubular element may be the male part and the engagement portion may be the female part.

In some embodiments, the ornamental component further comprises a second tubular element, and the first tubular element and the engagement portion of the locking element are positioned inside the second tubular element.

This may make it easier to insert the insert assembly into the self-supporting housing. The second tubular element may additionally hide non-decorative elements of the ornamental component, when the self-supporting housing is transparent or semi-transparent. The second tubular element may additionally protect the attachment between the first tubular element and the engagement portion.

The second tubular element may have a length along the through hole axis being approximately equal to the length of the self-supporting housing. The second tubular element may be fully inserted into the through hole of the self-supporting housing. The engagement portion of the locking element may be fully inserted into the second tubular element.

In some embodiments, the male/female locking mechanism is of the snap lock type wherein a translation and/or rotation from a free rotational orientation and/or position of the male and female part, to a locked rotational orientation and/or position of the male and female part, requires less force than a translation and/or rotation from a locked rotational orientation and/or position of the male and female part to a free rotational orientation and/or position of the male and female part.

This may be beneficial as the locking element and the first tubular element typically are permanently attached.

In some embodiments, the male/female locking mechanism is of the rotational lock type, wherein the female part (the engagement portion or the first tubular element) comprises a recess and/or opening configured to allow the protruding portion of the male part to translate inside the recess and/or opening along the through hole axis when the locking element is in a free rotational orientation relative to the first tubular element, and to be prevented from moving in at least a first direction along the through hole axis when the locking element is in a locked position relative to the first tubular element and the locking element is in a locked rotational orientation relative to the first tubular element.

In some embodiments, the male part comprises a plurality of protruding portions and the female part comprises a plurality of recesses and/or openings.

When the male/female locking mechanism is of the rotational type, the locking element may be attached to the first tubular element by firstly rotationally orienting the locking element in the free rotational orientation relative to the first tubular element, next translating the first tubular element and/or the locking element along the through hole axis until the locking element is in the locked position relative to the first tubular element, and finally rotating the first tubular element and/or the locking element from the free rotational orientation to the locked rotational orientation.

The protruding portion of the male part and/or the recess and/or opening of the female part may be configured so that a rotation from the free rotational orientation to the locked rotational orientation requires less force than a rotation from the locked rotational orientation to the free rotational orientation.

In some embodiments, the male part (the engagement portion or the first tubular element) comprises a flexible member configured to deform from a first shape to a second shape when the male part comes into contact with the female part, and further to snap back into approximately the first shape when the flexible member is aligned with the recess and/or opening of the female part, whereby the flexible member engages with the recess and/or opening and locks the male part to the female part, allowing the locking element to be attached to the first tubular element by a pure translation between the two.

In some embodiments, the male part comprises two flexible members, and the female part comprises two recesses and/or openings.

The two flexible members may be arranged at opposite sides of the male part. Correspondingly, the two recesses and/or openings may be arranged at opposite sides of the female part.

In some embodiments, the engagement part of the locking element is inserted into the first tubular element whereby the through hole of the locking element and the through hole of the first tubular element together form the through hole of the ornamental component.

In some embodiments, the first tubular element at a first end further comprises a collar positioned outside the self-supporting housing at the first opening of the self-supporting housing. A surface abuts an outer surface of the self-supporting housing thereby preventing the first tubular element from moving in a first direction along the through hole axis relative to the ornamental component.

In some embodiments, the locking element further comprises a collar positioned outside the self-supporting housing at the second opening of the self-supporting housing. The collar includes a surface abutting an outer surface of the self-supporting housing thereby preventing the first tubular element from moving in a second direction along the through hole axis relative to the ornamental component.

In some embodiments, the first tubular element is part of an insert assembly inserted in the through hole of the self-supporting housing through the first opening of the self-supporting housing. The insert assembly is assembled from the first tubular element and a gripping element for frictionally gripping a part of the bracelet and/or necklace. The first tubular element is configured to secure the gripping element inside the through hole of the ornamental component.

According to a sixth aspect, the invention relates to a method for manufacturing an ornamental component having a through hole allowing the ornamental component to be strung on an elongated member of a bracelet and/or necklace, with the through hole defining a through hole axis. The method comprises the steps: (a) providing a self-supporting housing, having an through hole, wherein the through hole comprises a first opening at a first side of the self-supporting housing and a second opening at a second side of the self-supporting housing; (b) inserting through the first opening of the self-supporting housing a first tubular element having a through hole; (c) inserting through the second opening of the self-supporting housing a locking element having a through hole, the locking element comprising an engagement portion for being positioned inside the through hole of the self-supporting housing; and (d) attaching the engagement portion of the locking element to the first tubular element.

Consequently, by using two parts inserted from two sides of the ornamental component, the lining (the first tubular element and the locking element) may be attached to the bead without deforming it. This allows more complex insert elements to be used such as pre decorated linings and linings composed of a plurality of elements.

In some embodiments, the engagement portion is attached to the tubular element by a male/female locking mechanism.

In some embodiments, the method further comprises the step of inserting a second tubular element into the through hole of the self-supporting housing, either through the first opening or the second opening of the self-supporting housing, wherein the first tubular element and the engagement portion of the locking element are inserted into the second tubular element.

In some embodiments, the ornamental component is an ornamental component as disclosed in relation to the fifth aspect of the invention.

The different aspects of the present invention can be implemented in different ways including as ornamental components, bracelets or necklaces comprising ornamental components, tubular elements for ornamental components, and methods for manufacturing ornamental components described above and in the following, each yielding one or more of the benefits and advantages described in connection with at least one of the aspects described above, and each having one or more preferred embodiments corresponding to the preferred embodiments described in connection with at least one of the aspects described above and/or disclosed in the dependent claims.

Furthermore, it will be appreciated that embodiments described in connection with one of the aspects described herein may equally be applied to the other aspects. Aspects of the first tubular element disclosed in relation to the first aspect of the invention may be applied to the tubular element disclosed in relation to the fourth aspect of the invention and vice versa. Similarly, aspects disclosed in relation to the ornamental component disclosed in relation to the first aspect of the invention may be applied to the method disclosed in relation to the third aspect of the invention and vice versa. Further aspects disclosed in relation to the ornamental component disclosed in relation to the fifth aspect of the invention may be applied to the method disclosed in relation to the sixth aspect of the invention and vice versa.

In the following description, reference is made to the accompanying figures, which show by way of illustration how the invention may be practiced.

Figure 1B:
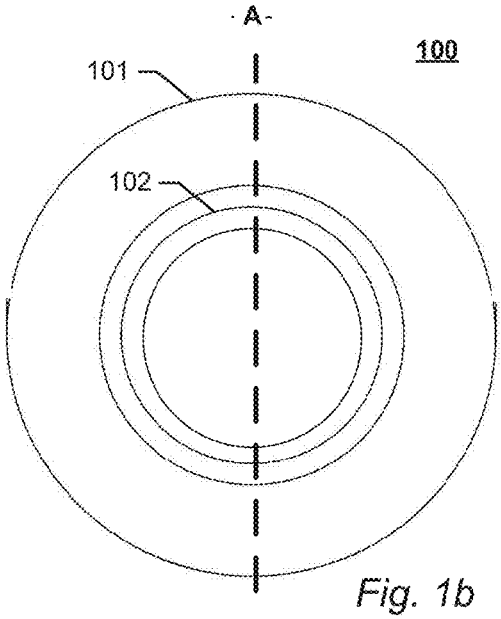
Figure 1C:
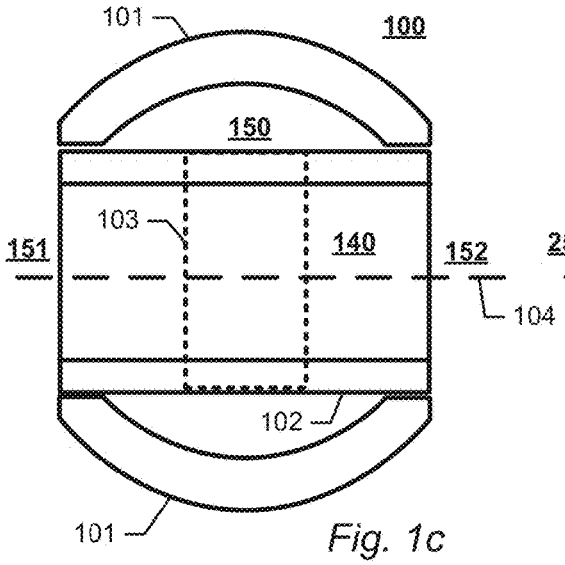
Figure 2:
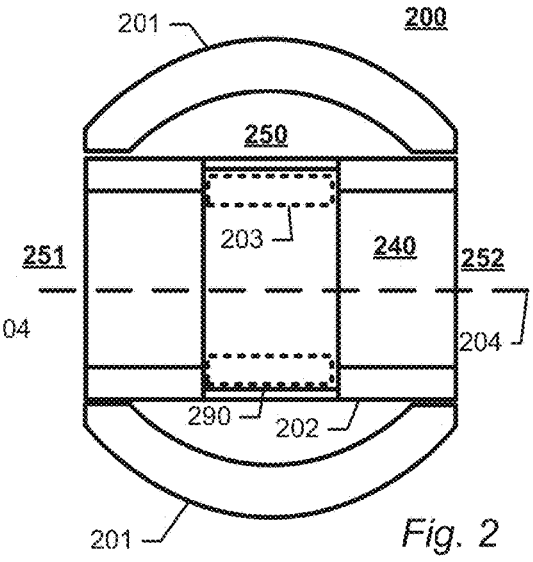
FIG. 2 shows an ornamental component according to an embodiment of the present invention.

FIGS. 1*a-c* show an ornamental component 100 for a bracelet and/or a necklace having a through hole defining a through hole axis 104, according to an embodiment of the present invention. FIG. 1*a* shows a side view, FIG. 1*b* shows a front view, and FIG. 1*c* shows a cross-section along the line A shown in FIG. 1*b*. The ornamental component 100 comprises a self-supporting housing 101 having a through hole 150 comprising a first opening at a first side of the self-supporting housing 151 and a second opening at a second side of the self-supporting housing 152, and an insert assembly 102 103 inserted in the through hole 150 of the self-supporting housing 101. The insert assembly 102 103 comprises a first tubular element 102 and a gripping element 103 (only schematically shown). The gripping element 103 is configured for frictionally gripping a part of a bracelet and/or necklace. The first tubular element 102 has a through hole 140 which in this embodiment forms the full through hole of the ornamental component 100. However, in other embodiments of the invention the through hole of the first tubular element 140 forms only a limited part of the through hole of the ornamental component 100. The through hole of the ornamental component allows it to be strung on an elongated member of a bracelet and/or necklace. The trough hole of the self-supporting housing 150 has a varying width (measured in planes being perpendicular to the through hole axis), i.e. the through hole of the self-supporting housing 150 is wider in the central part of self-supporting housing than at the first opening 151 and the second opening 152. The inner surface of the through hole of the self-supporting housing 150 is spaced apart from the insert assembly 102 103 by a fluid e.g. air. The first tubular element 102 is configured to secure the gripping element 103 inside the through hole 150 of the ornamental component. This may be achieved by attaching the gripping element 103 to the first tubular element 102 e.g. by adhering the two elements together or by positioning the gripping element 103 in a recess of the first tubular element 102 e.g. as shown in FIG. 2. The first tubular element 102 may alternatively secure the gripping element 103 inside the through hole 150 of the ornamental component by having a part of the gripping element wrapped around its outer surface as disclosed in relation to FIGS. 3-5.

FIG. 2 shows a cross-section of an ornamental component 200 for a bracelet and/or a necklace having a through hole defining a through hole axis 204 according to an embodiment of the present invention. The ornamental component 200 comprises a self-supporting housing 201 having a through hole 250 comprising a first opening at a first side of the self-supporting housing 251 and a second opening at a second side of the self-supporting housing 252, and an insert assembly 202 203 inserted in the through hole 250 of the self-supporting housing 201. The insert assembly 202 203 comprises a first tubular element 202 and a gripping element 203. The gripping element 203 is configured for frictionally gripping a part of a bracelet and/or necklace. The gripping element 203 has a tubular shape. The first tubular element 202 is configured to secure the gripping element 203 in the through hole of the ornamental component by having recess 290 in the central part of the inner wall of its through hole 240, where the gripping element 203 is positioned. Optionally, the gripping element 203 may further be adhered to the inner wall of the first tubular element 202. The through hole of the first tubular element 240 forms the full through hole of the ornamental component 200.

Figure 3:
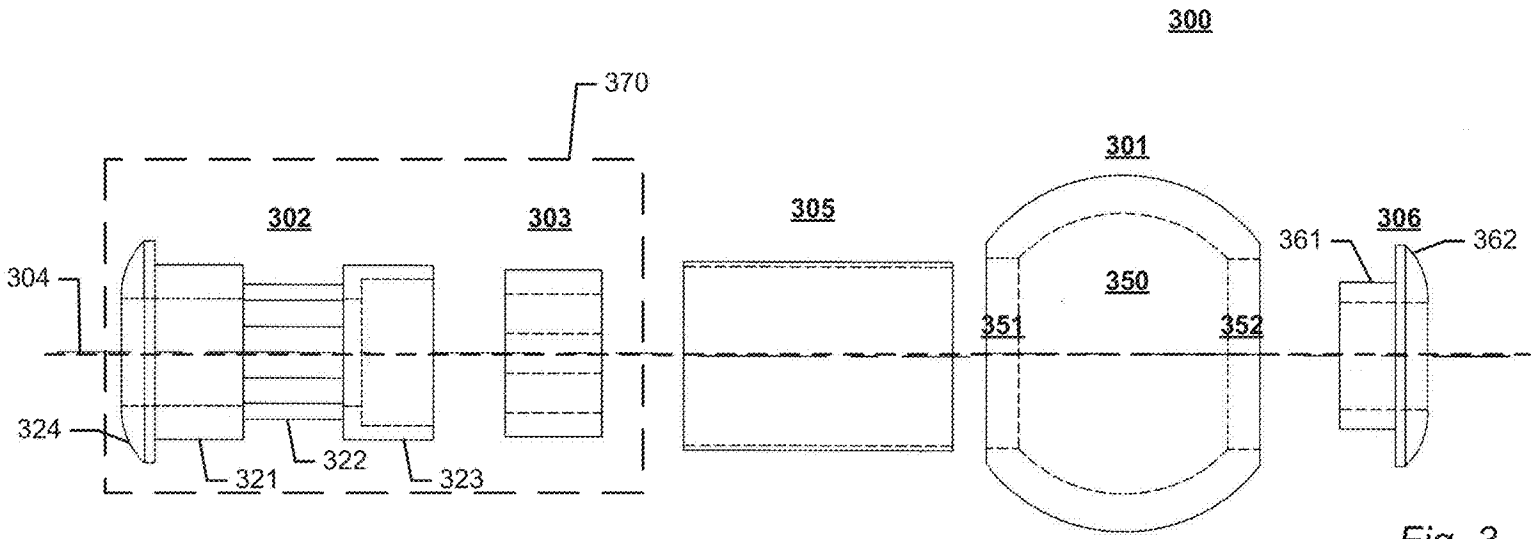
FIG. 3 shows an ornamental component according to an embodiment of the present invention.

FIG. 3 shows an exploded view of an ornamental component 300 according to an embodiment of the present invention. The ornamental component 300 comprises an insert assembly 370, a second tubular element 305, a self-supporting housing 301, and a locking element 306. The insert assembly 370 comprises a first tubular element 302 and a gripping element 303. Shown is also the through hole axis 304. The first tubular element 302 has a through hole and comprises a collar 324, a first part 321, a second part 322, and a third part 323, as will be more detailed explained in relation to FIGS. 4*a-d*. The locking element 306 has a through hole, and comprises an engagement part 361 for engaging with the insert assembly 370 and a collar 362 for being positioned outside the self-supporting housing 301. The ornamental component 300 may be manufactured/assembled by firstly assembling the insert assembly 370. The insert assembly 370 may be assembled by arranging the gripping element 303 around the second portion 322 of the first tubular element 302, so that gripping portions of the gripping element 303 (not shown) extends through circumferential openings of the first tubular element 302. Next, the insert assembly 370 may be inserted into the second tubular element 305. Then the insert assembly 370 with the second tubular element may be inserted into a through hole of the self-supporting housing 350 in a manner so that the collar 324 is positioned outside the self-supporting housing 301. The second tubular element 305 may alternatively be inserted into the through hole of the self-supporting housing 350 before the insert assembly 370 is inserted. The insert assembly 370 and/or the second tubular element 305 may be inserted into the through hole of the self-supporting housing 350 through a first opening 351. The insert assembly 370 and/or the second tubular element 305 may alternatively be inserted into the through hole of the self-supporting housing 350 before the self-supporting housing 301 is fully formed/assembled e.g. the insert assembly 370 and/or the second tubular element may be inserted into a first half of the self supporting housing 301, whereafter a second half of the self-supporting housing 301 is attached to the first half, thereby forming the finished self-supporting housing 301 with the insert assembly 370 inserted in its through hole 350. Finally, the locking element 306 is inserted in a second opening 352 of the through hole of the self-supporting housing 350, and the engagement part 361 is attached to the first tubular element 302.

Figure 4A:
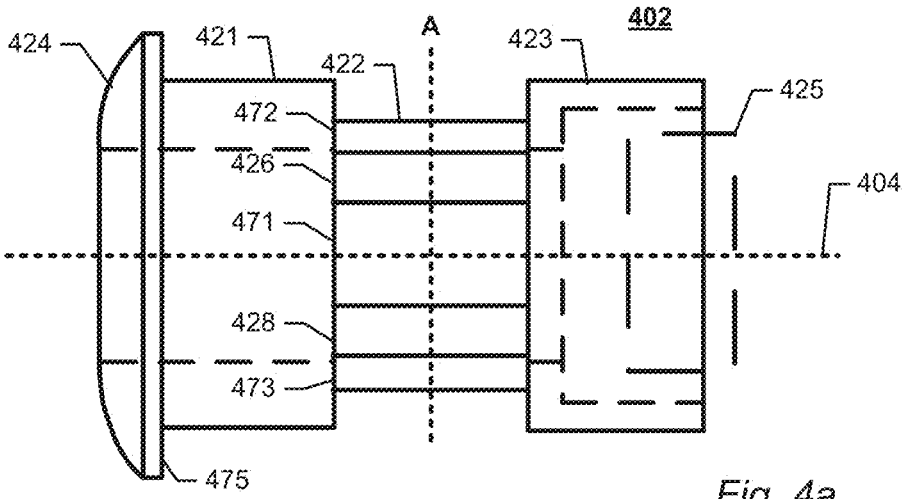
FIGS. 4*a-d* show a first tubular element according to an embodiment of the present invention.
Figure 4B:
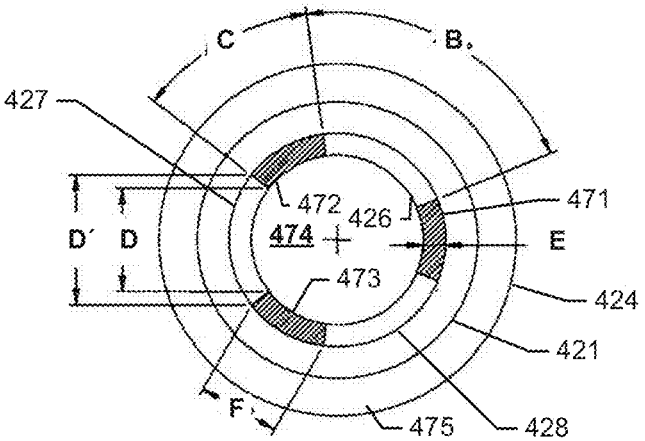
Figure 4C:
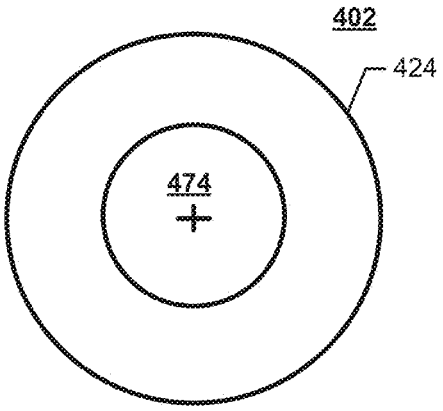
Figure 4D:
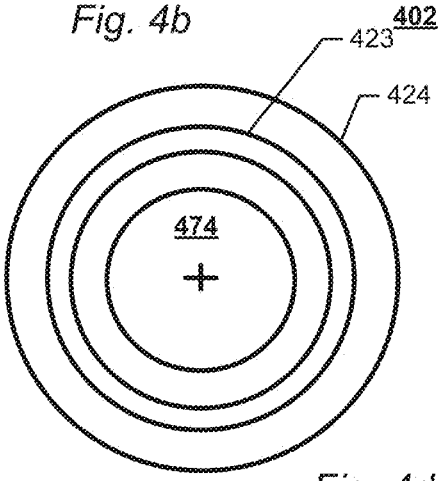

FIGS. 4*a-d* show a first tubular element comprising a through hole according to an embodiment of the present invention. The first tubular element shown in FIG. 4-*d* may correspond to the first tubular element 302 shown in FIG. 3. FIG. 4*a* shows a side view, FIG. 4*b* shows a cross-section along the line A, FIG. 4*c* shows a front view, and FIG. 4*d* shows a back view. The first tubular element 402 comprises a through hole 474 defining a tubular element through hole axis 404. When the first tubular element 402 is positioned in an ornamental component according the invention, the tubular element through hole axis 404 and the ornamental component through hole axis will be coincident. The first tubular element 402 comprises a first portion 421, a second portion 422, and a third portion 423. The width of the second portion 422 is lower than the widest width of the first portion 421 and the third portion 423. The first tubular element 402 further comprises a collar 424, a first circumferential opening 426, a second circumferential opening 427, and a third circumferential opening 428. Each of the circumferential openings 426 427 428 extends along the tubular element through hole axis 404. The circumferential openings 426 427 428 are spaced apart by walls 471 472 473 extending along to tubular element through hole axis 404. Each of the circumferential openings 426 427 428 extends B percentage of the circumference of the first tubular element. In the embodiment shown B is equal to 20.8%, i.e. 75 degrees. Correspondingly, each of the walls 471 472 473 extends C percentage of the circumference of the first tubular element. In the embodiment shown C is equal to 12.5%. The circumferential openings 426 427 428 are used to allow griping parts of the gripping element to extend through, into the through hole 474 of the first tubular element 402, thereby allowing the gripping parts to grip an elongated member of a bracelet and/or necklace. The collar 424 comprises a surface 474 for abutting an outer surface of a self-supporting housing for preventing the first tubular element 402 from moving in a first direction along the through hole axis relative to the self-supporting housing. The width of the through hole 474 is slightly extended in a part of the third portion 423, as illustrated by the broken line in FIG. 4*a*. This may allow an engagement portion of a locking element to be received, whereby a through hole of the locking element and the through hole 474 of the first tubular element 402 together can form a through hole of an ornamental component. The first tubular element 402 may optionally further comprise mechanical locking means 425 for mechanically attaching the first tubular element 402 with an engagement portion of a locking element e.g. a male/female locking mechanism. In some embodiments, the first tubular element 402 has a length along the tubular element through hole axis 404 between 1 mm and 3 cm.

Figure 5A:
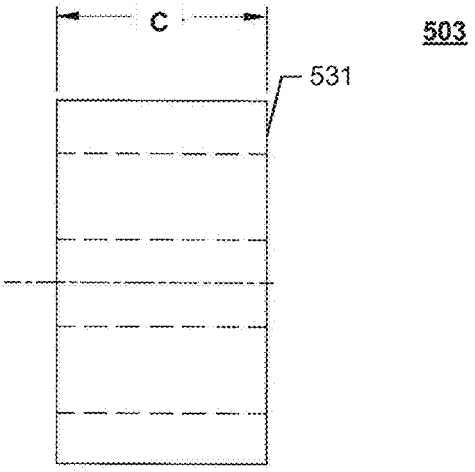
FIG. 5*a-b* show a gripping element according to an embodiment of the present invention.
Figure 5B:
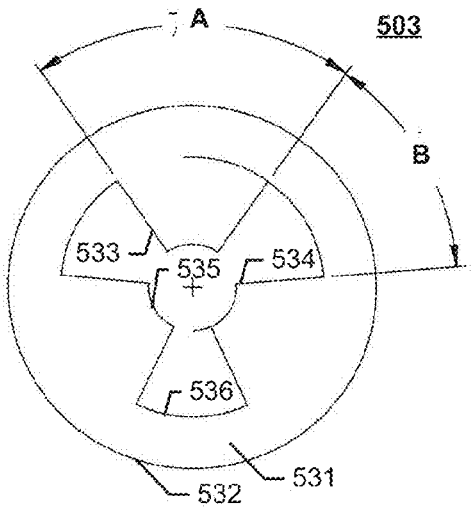

FIGS. 5*a-b* show a gripping element according to an embodiment of the present invention. FIG. 5*a* shows a side view, and FIG. 5*b* shows a front view. The gripping element 503 shown in FIG. 5*a-b* may correspond to the gripping element 303 shown in FIG. 3. The gripping element comprises a tubular portion 531 having an outer surface 532 and an inner surface 536. The gripping element 503 further comprises a first gripping portion 533, a second gripping portion 534, and a third gripping portion 535 protruding from the inner surface 536 of the tubular portion 531. Each of the gripping portions 533 534 535 protrudes from A percentage of the inner surface 536 of the tubular portion 531. In the embodiment shown A is equal to 19.4%, i.e. 70 degrees. The gripping portions 533 534 535 are used to resiliently grip an elongated member of a bracelet and/or necklace. The gripping element 503 may be made of a flexible material e.g. a silicone like material. The gripping element 503 may be attached with a first tubular element 402 as shown in FIG. 4*a-d* by pulling the gripping element 503 around the first tubular element 402 until the first gripping portion 533 is aligned with the first circumferential opening 426, the second gripping portion 534 is aligned with the second circumferential opening 427, and the third gripping portion 535 is aligned with the third circumferential opening 428, whereby the first gripping portion 533 extends through the first circumferential opening 426, the second gripping portion 534 extends through the second circumferential opening 427, the third gripping portion 535 extends through the third circumferential opening 428, and a part of the inner surface 536 of the tubular portion 531 rests upon a part of the outer surface 471 472 473 of the first tubular element 402 thereby attaching the gripping element 503 to the first tubular element 502. The gripping element 503 may have a length C along the through hole axis, being approximately equal to the length of the circumferential openings of a first tubular element.

Figure 6A:
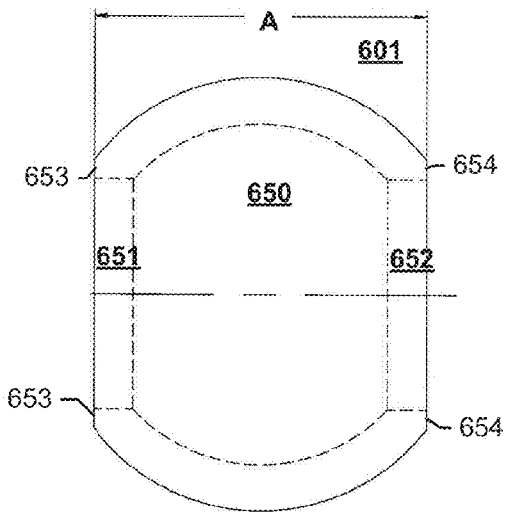
FIG. 6*a-b* show a self-supporting housing according to an embodiment of the present invention.
Figure 6B:
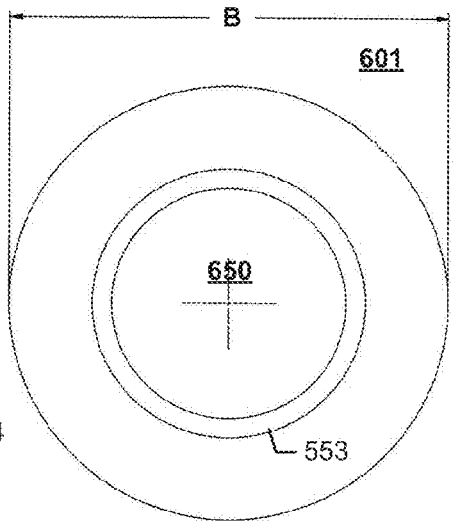

FIGS. 6*a-b* show a self-supporting housing according to an embodiment of the present invention. FIG. 6*a* shows a side view and FIG. 6*b* shows a front view. The self-supporting housing 601 shown in FIGS. 6*a-b* may correspond to the self-supporting housing 301 shown in FIG. 3. The self-supporting housing 601 has a through hole 650 comprising a first opening at a first side of the self-supporting housing 651 and a second opening at a second side of the self-supporting housing 652. The trough hole of the self-supporting housing 650 has a varying width (measured in planes being perpendicular to the through hole axis), i.e. the through hole of the self-supporting housing 650 is wider in the central part of self-supporting housing than at the first opening 651 and the second opening 652. The self-supporting housing 601 comprises a planar surface 653 at the first opening 651 for abutting a surface of a collar of a first tubular element. Correspondingly, the self supporting housing 601 comprises a planar surface 654 for abutting a surface of a collar of a locking element.

Figure 7A:
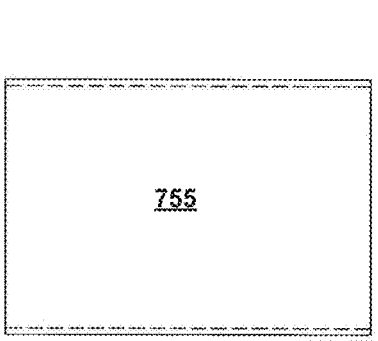
FIG. 7*a-b* show a second tubular element according to an embodiment of the present invention.
Figure 7B:
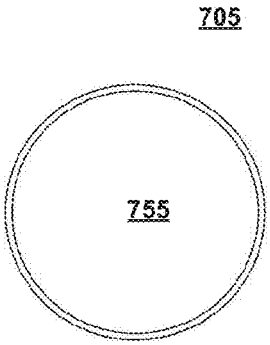

FIGS. 7*a-b* show a second tubular element according to an embodiment of the present invention. FIG. 7*a* shows a side view and FIG. 7*b* shows a front view. The second tubular element 705 shown in FIGS. 7*a-b* may correspond to the second tubular element 305 shown in FIG. 3. The second tubular element comprises a through hole 755, wherein a first tubular element with a gripping element attached may be positioned.

Figure 8A:
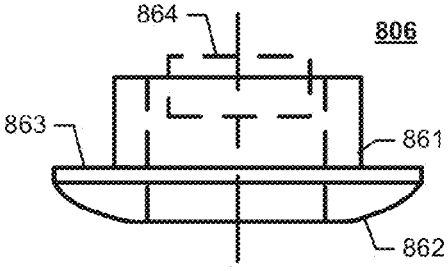
FIG. 8*a-c* show a locking element according to an embodiment of the present invention.
Figure 8B:
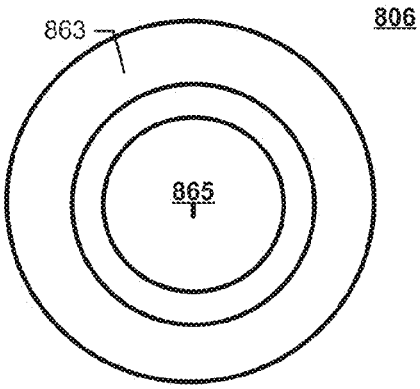
Figure 8C:
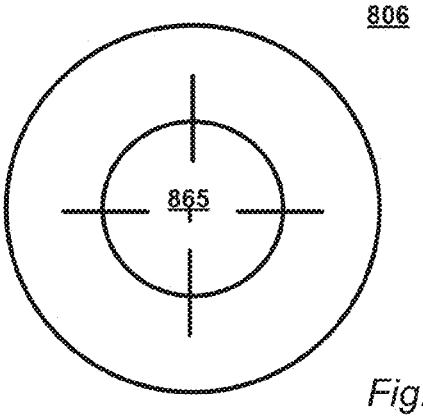

FIGS. 8*a-b* show a locking element according to an embodiment of the present invention. FIG. 8*a* shows a top view, FIG. 8*b* shows a back view and FIG. 8*c* shows a front view. The locking element 806 shown in FIGS. 8*a-c* may correspond to the locking element 306 shown in FIG. 3. The locking element 806 comprises an engagement portion 861 for being attached with a part of a first tubular element, a collar for being positioned outside a self-supporting housing, and a through hole 865. The engagement portion 861 may optionally comprise mechanical locking means 864 for mechanically attaching the engagement portion 861 with a first tubular element 402 e.g. a male/female locking mechanism. The collar 862 comprises a planar surface 863 for abutting with a surface of a self-supporting housing.

Figure 9:
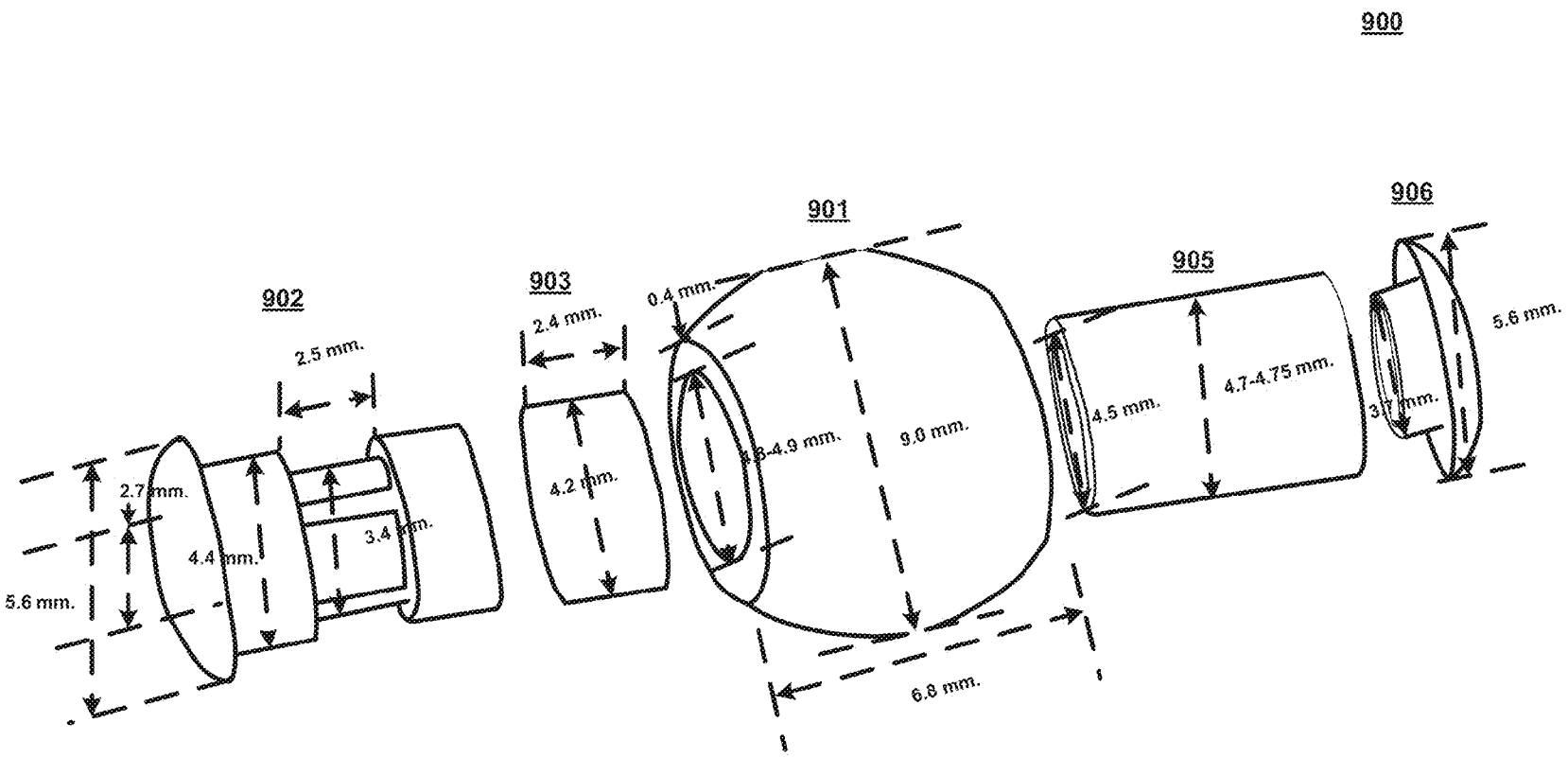
FIG. 9 shows an ornamental component according to an embodiment of the present invention.

FIG. 9 shows an exploded perspective view of an ornamental component with possible dimensions according to an embodiment of the present invention. The ornamental component 900 comprises a first tubular element 902, a gripping element 903, a self-supporting housing 901, a second tubular element 905, and a locking element 906.

Figure 10A:
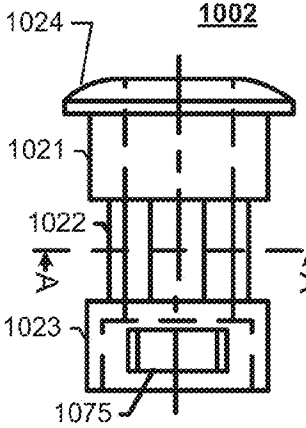
FIGS. 10*a-d* show a first tubular element according to an embodiment of the present invention.
Figure 10B:
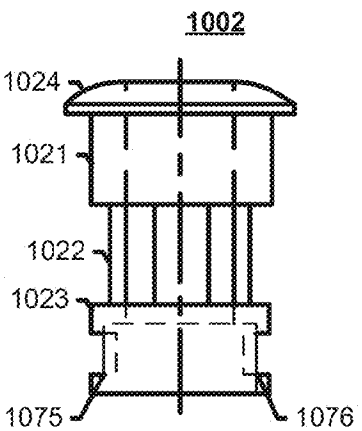
Figure 10C:
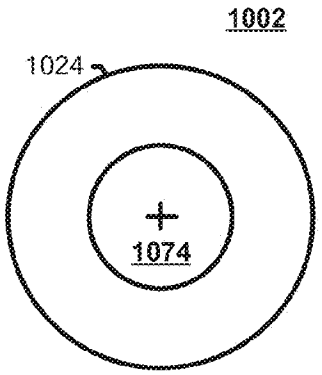
Figure 10D:
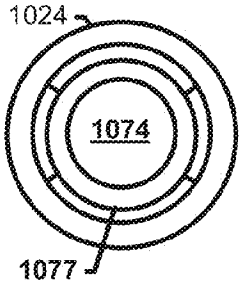

FIGS. 10*a-d* show a first tubular element according to an embodiment of the present invention. FIG. 10*a* shows a top view, FIG. 10*b* shows a side view, FIG. 10*c* shows a front view and FIG. 10*d* shows a back view. The first tubular element 1002 has a through hole 1074 and comprises a collar 1024, a first portion 1021, a second portion 1022, and a third portion 1023. The collar 1024, the first portion 1021, and the second portion 1022 may be identical to the corresponding parts of the first tubular element shown in FIG. 4*a-d*. The third portion 1023 comprises mechanical locking means in the form of a female part of male/female locking mechanism 1075 1076. The female part 1075 1076 comprises a first opening 1075 and a second opening 1076 extending along the through hole axis. The first opening 1075 and the second opening 1076 are positioned opposite to each other.

Figure 11A:
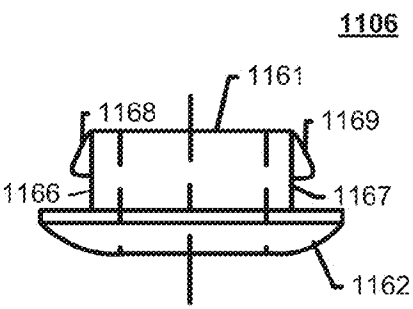
FIG. 11*a-c* show a locking element according to an embodiment of the present invention.
Figure 11B:
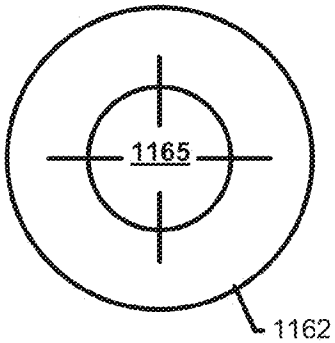
Figure 11C:
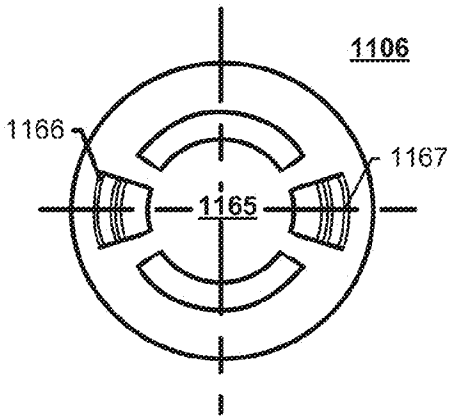

FIGS. 11*a-d* show a locking element 1106 according to an embodiment of the present invention. FIG. 11*a* shows a top view, FIG. 11*b* shows a front view and FIG. 11*c* shows a back view. The locking element 1106 has a through hole 1165 and comprises a collar 1162 and an engagement portion 1161. The collar 1162 may be identical to the collar of the locking element shown in FIG. 8. The engagement portion 1161 comprises mechanical locking means in the form of the male part 1166 1167 of a male/female locking mechanism. The male part 1166 1167 comprises a first flexible member 1166 and a second flexible member 1167. The first and second flexible member 1166 1167 each comprises a protruding portion 1168 1169. The male/female locking mechanisms shown in FIGS. 10*a-c* and FIGS. 11*a-c* are configured to function together, thus the protruding portions 1168 1169 are configured to fit the openings 1075 1076. The locking element 1106 may be attached to the first tubular element 1002 by moving the two elements together until the male part comes into contact with the female part, whereby the first and second flexible member 1166 1167 are deformed from a first shape to a second shape, i.e. the first and second flexible member 1166 1167 are both progressively bent inwards. This is a result of an interaction between the rounded front surface of the two flexible members 1166 1167 and the rim 1077 of the through hole 1074 of the first tubular element 1002. When the two flexible members 1166 1667 are aligned with the two openings 1075 1076 of the first tubular element 1002, the two flexible members 1166 1667 snap back into approximately the first shape, whereby the protruding portions of the two flexible members 1168 1669 engages with the openings 1075 1076 and locks the locking element 1106 to the first tubular element 1002. Thus, the locking element 1106 can be attached to the first tubular element 1002 by a pure translation between the two. The male/female locking mechanism 1075 1076 1166 1167 is of the snap lock type wherein a translation from a free position of the male and female part, to a locked position of the male and female part, requires less force than a translation from a locked position of the male and female part to a free position of the male and female part. This is a result of the special shape of the protruding portions 1168 1669 and the openings 1075 1076. This may be beneficial as the locking element 1106 and the first tubular element 1002 typically are permanently attached.

Figure 12:
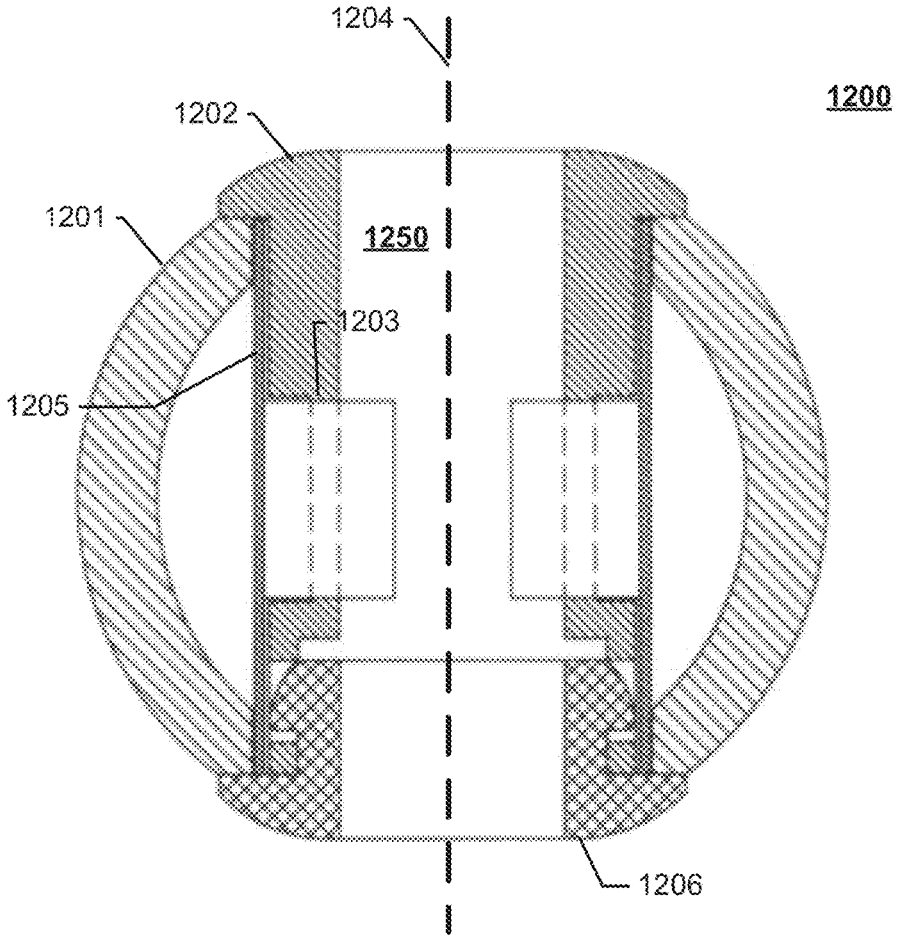
FIG. 12 shows an ornamental component according to an embodiment of the present invention.

FIG. 12 shows a central cross-section of a fully assembled ornamental component comprising a first tubular element and a locking element as disclosed in relation to FIGS. 10*a-d* and FIGS. 11*a-c* according to an embodiment of the present invention. The ornamental component 1200 comprises a self-supporting housing 1201, a first tubular element 1202, a gripping element 1203, a locking element 1206 and a second tubular element 1205. The ornamental component 1200 has a through hole 1250 defining a through hole axis 1204. The gripping element 1203 may be identical to the gripping element shown in FIGS. 5*a-b*, the self-supporting housing 1201 may be identical to the self-supporting housing shown in FIGS. 6*a-b*, and the second tubular element 1205 may be identical to the second tubular element shown in FIGS. 7*a-b*. It can be seen how gripping portions of the gripping element 1203 protrudes into the through hole 1250 of the ornamental component 1200 allowing the gripping portions to frictionally grip an elongated member of an bracelet and/or necklace e.g. a chain of a bracelet and/or necklace.

FIGS. 13*a-d* show a first tubular element according to an embodiment of the present invention. FIG. 13*a* shows a top view, FIG. 13*b* shows a side view, FIG. 13*c* shows a front view, and FIG. 13*d* shows a back view. The first tubular element 1302 has a through hole 1374 and comprises a collar 1324, a first portion 1321, a second portion 1322, and a third portion 1323. The collar 1324, the first portion 1321, and the second portion 1322 may be identical to the corresponding parts of the first tubular element shown in FIG. 4*a-d*. The third portion 1323 comprises mechanical locking means in the form of a female part of male/female locking mechanism 1375 1376. The female part 1075 1076 comprises a first opening/or recess 1375 and a second opening or recess 1376. The first opening 1375 and the second opening 1376 are positioned opposite to each other.

FIGS. 14*a-d* show a locking element 1406 according to an embodiment of the present invention. FIG. 14*a* shows a top view, FIG. 14*b* shows a front view, and FIG. 14*c* shows a back view. The locking element 1406 has a through hole 1465, and comprises a collar 1462 and an engagement portion 1461. The collar 1462 may be identical to the collar of the locking element shown in FIG. 8. The engagement portion 1461 comprises mechanical locking means in the form of the male part 1468 1469 of a male/female locking mechanism. The male part 1468 1469 comprises a first protruding portion 1468 and a second protruding portion 1169. The male/female locking mechanisms shown in FIGS. 13*a-c* and FIGS. 114-*c* are configured to function together, thus the protruding portions 1468 1469 are configured to fit the openings 1375 1376. The male/female locking mechanism is of the rotational type. The locking element 1406 may be attached to the first tubular element 1302 by firstly rotationally orienting the locking element 1406 in a free rotational orientation relative to the first tubular element 1302 (with the protruding portions 1468 1469 aligned with the openings 1375 1376), next translating the locking element 1406 along the through hole axis, and finally rotating the locking element 1406 from the free rotational orientation to a locked rotational orientation.

Figure 15:
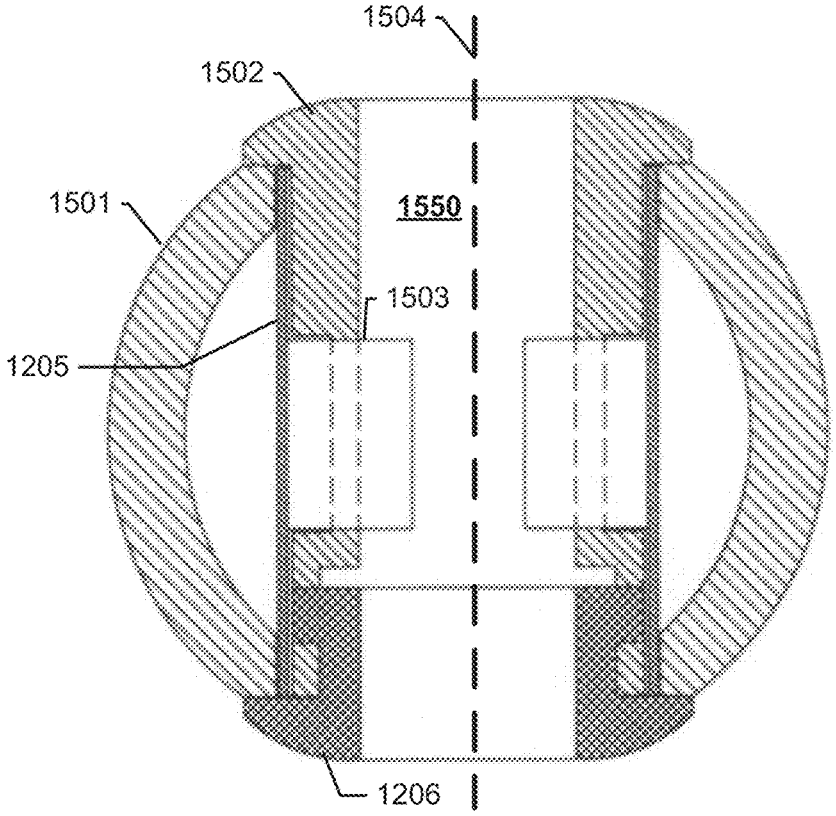
FIG. 15 shows an ornamental component according to an embodiment of the present invention.

FIG. 15 shows a central cross-section of a fully assembled ornamental component comprising a first tubular element and a locking element as disclosed in relation to FIGS. 13*a-d* and FIGS. 14*a-c*, according to an embodiment of the present invention. The ornamental component 1500 comprises a self-supporting housing 1501, a first tubular element 1502, a gripping element 1503, a locking element 1506, and a second tubular element 1505. The ornamental component 1500 has a through hole 1550 defining a through hole axis 1504. The gripping element 1503 may be identical to the gripping element shown in FIGS. 5*a-b*, the self-supporting housing 1501 may be identical to the self-supporting housing shown in FIGS. 6*a-b*, and the second tubular element 1505 may be identical to the second tubular element shown in FIGS. 7*a-b*.

Figure 16A:
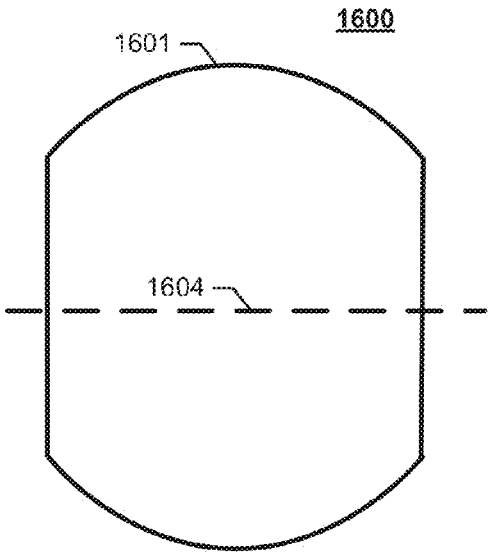
FIG. 16*a-c* show an ornamental component according to an embodiment of the present invention.
Figure 16B:
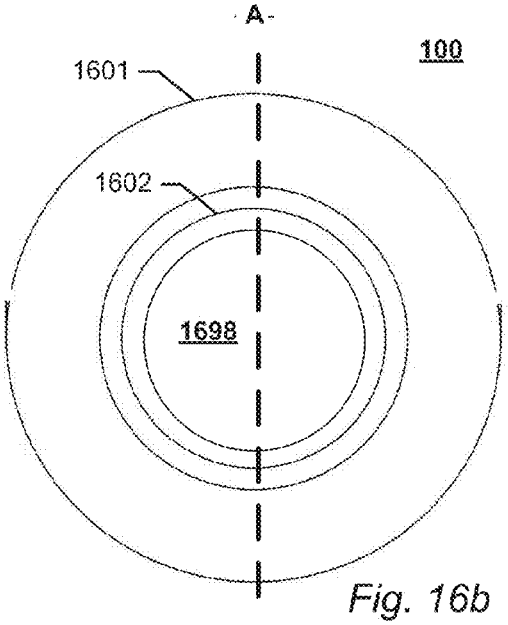
Figure 16C:
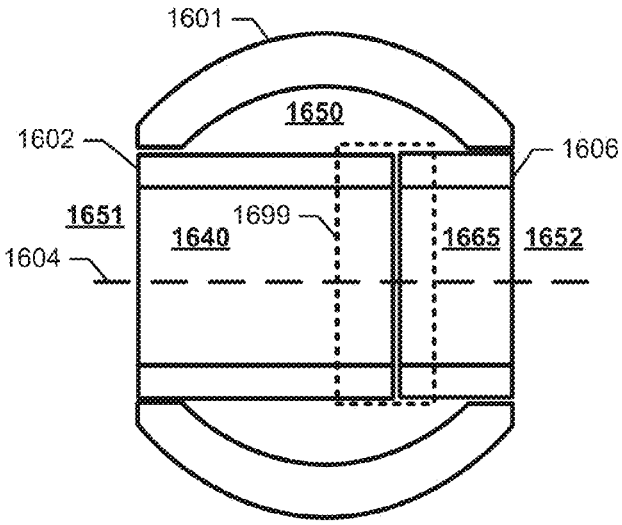

FIGS. 16*a-c* show an ornamental component according to an embodiment of the present invention. FIG. 16*a* shows a side view, FIG. 16*b* shows a front view, and FIG. 16*c* shows a cross-section along the line A shown in FIG. 16*b*. The ornamental component 1600 is an ornamental component for use with a bracelet and/or necklace e.g. a bead. The ornamental component 1600 has a through hole 1698 allowing the ornamental component 1600 to be strung on an elongated member of a bracelet and/or necklace, the through hole 1698 defines a through hole axis 1604. The ornamental component 1600 comprises a self-supporting housing 1601, a first tubular element 1602, and a locking element 1606. The self-supporting housing 1601 has a through hole 1650 comprising a first opening 1651 at a first side of the housing, and a second opening 1652 at a second side of the housing. The first tubular element 1602 has a through hole 1640, and is inserted in the through hole of the self-supporting housing 1650 through the first opening of the self-supporting housing 1651. The locking element 1606 has a through hole 1655 and is inserted in the through hole of the self-supporting housing 1650 through the second opening of the self-supporting housing 1652. The locking element 1606 and the first tubular element 1602 are attached as schematically shown by the box 1699. The through hole of the first tubular element 1640 and the through hole of the locking element 1665 together form the through hole of the ornamental component 1698. The ornamental component 1600 may be a freely movable ornamental component or an ornamental component configured to resiliently grips an elongated member of a bracelet and/or necklace.

Figure 17A:
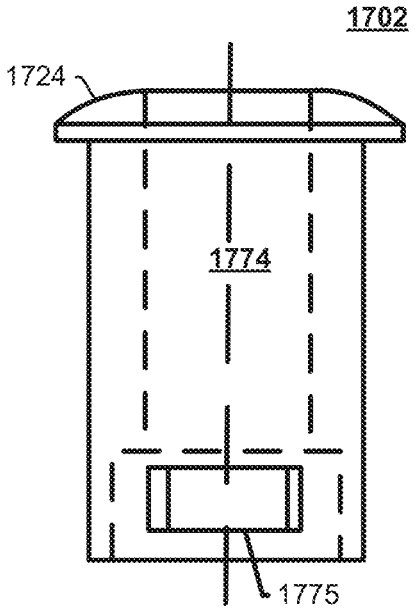
FIGS. 17*a-b* show a first tubular element according to an embodiment of the present invention.
Figure 17B:
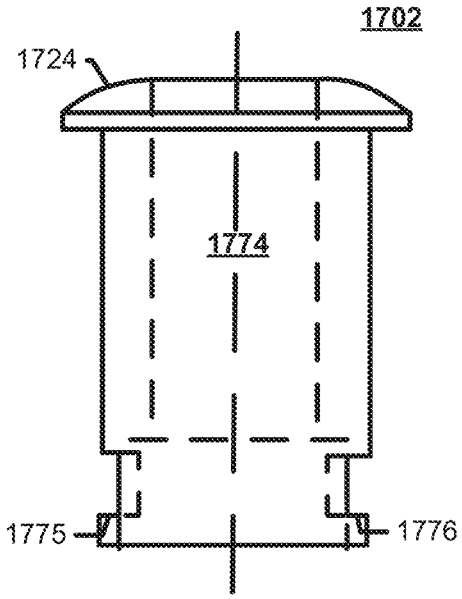

FIGS. 17*a-b* show an first tubular element for a freely movable ornamental component according to an embodiment of the present invention. FIG. 17*a* shows a top view and FIG. 17*b* shows a side view. The first tubular element 1702 has a through hole 1774. The first tubular element comprises a collar 1724 for being positioned outside a self-supporting housing, and mechanical locking means in the form of a female part of male/female locking mechanism 1775 1776. The female part 1775 1776 comprises a first opening 1775 and a second opening 1776 extending along the through hole axis. The first opening 1775 and the second opening 1776 are positioned opposite to each other. The male/female locking mechanism may be configured to function together with the male/female locking mechanism of the locking element 1106 shown in FIGS. 11*a-d* i.e. the locking 1106 may be attached to the first tubular element 1702 by their respective male/female locking mechanisms.

Figure 18:
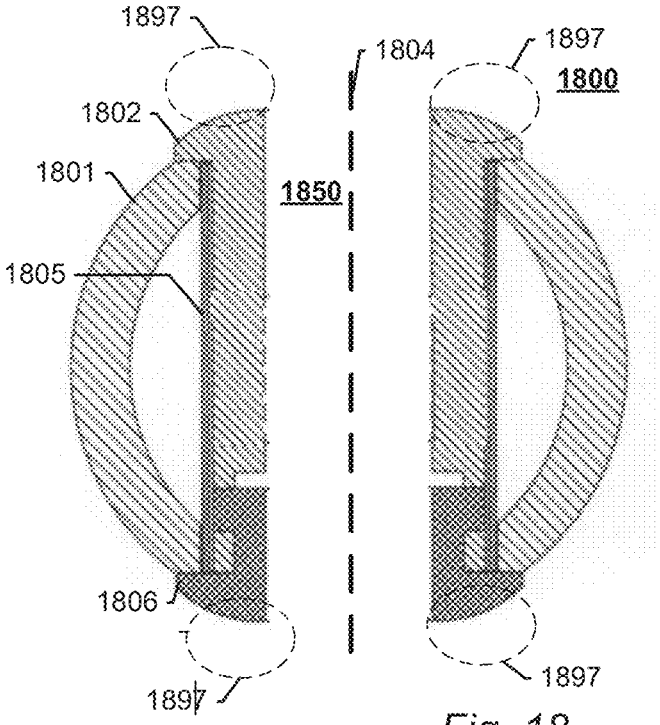
FIG. 18 shows an ornamental component according to an embodiment of the present invention.

FIG. 18 shows a central cross-section of a fully assembled ornamental component configured to be freely movable, according to an embodiment of the present invention. The ornamental component 1800 comprises a self-supporting housing 1801, a first tubular element 1802, a locking element 1806, and a second tubular element 1505. The ornamental component 1800 has a through hole 1850 defining a through hole axis 1804. The second tubular element 1805 may be identical to the second tubular element shown in FIGS. 7*a-b*. The first tubular element 1802 is a first tubular element as disclosed in relation to FIGS. 17*a-b*, and the locking element 1806 is a locking element as disclosed in relation to FIGS. 11*a-c*. The openings of the first tubular element 1802 and/or the openings of the locking element 1806 may optionally be pre-decorated e.g. comprise decorative engravings as schematically illustrated by the circles 1897.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

The invention claimed is:

1. An ornamental component for use with at least one jewelry item selected from the group consisting of a bracelet and a necklace; the ornamental component having a through hole with a through hole axis, the through hole allowing the ornamental component to be strung on an elongated member of a jewelry item; the ornamental component comprising:

a self-supporting housing having a through hole comprising a first opening at a first side of the self-supporting housing and a second opening at a second side of the self-supporting housing;

a first tubular element inserted in the through hole of the self-supporting housing through the first opening of the self-supporting housing, the first tubular element having a through hole; and a locking element inserted in the through hole of self-supporting housing through the second opening of the self-supporting housing, the locking element having a through hole and an engagement portion, the engagement portion being attached to the first tubular element;

wherein the ornamental component further comprises a second tubular element arranged in the through hole of the self-supporting housing, the inner surface of the through hole of the self-supporting housing is spaced apart from the second tubular element and the first tubular element and the engagement portion of the locking element are positioned inside the second tubular element.

2. An ornamental component according to claim 1, wherein the engagement portion is attached to the first tubular element by a male/female locking mechanism, wherein the male part comprises a protruding portion and the female part comprises a void, the void being at least one item selected from the group consisting of a recess and an opening.

3. An ornamental component according to claim 2, wherein the male part comprises a plurality of protruding portions and the female part comprises a plurality of voids.

4. An ornamental component according to claim 2, wherein the male/female locking mechanism is of the snap lock type, wherein a movement from a free configuration of the male and female part to a locked configuration of the male and female part requires less force than a movement from the locked configuration of the male and female part to the free configuration of the male and female part.

5. An ornamental component according to claim 4, wherein the male part comprises a flexible member configured to deform from a first shape to a second shape when the male part comes into contact with the female part, and further to snap back into approximately the first shape when the flexible member is aligned with the void of the female part, whereby the flexible member engages with the void and locks the male part to the female part, allowing the locking element to be attached to the first tubular element by a pure translation between the two.

6. An ornamental component according to claim 5, wherein the male part comprises two flexible members, and the female part comprises a second void, the second void being at least one item selected from the group consisting of a recess and an opening.

7. An ornamental component according to claim 2, wherein the male/female locking mechanism is of the rotational lock type, wherein the void is configured to allow the protruding portion of the male part to translate inside the void along the through hole axis when the locking element is in a free rotational orientation relative to the first tubular element, and to be prevented from moving in at least a first direction along the through hole axis when the locking element is in a locked position relative to the first tubular element and the locking element is in a locked rotational orientation relative to the first tubular element.

8. An ornamental component according to claim 1, wherein the first tubular element at a first end further comprises a collar positioned outside the self-supporting housing at the first opening of the self-supporting housing, the collar includes a surface abutting an outer surface of the self-supporting housing thereby preventing the first tubular element from moving in a first direction along the through hole axis relative to the ornamental component.

9. An ornamental component according to claim 8, wherein the locking element further comprises a collar positioned outside the self-supporting housing at the second opening of the self-supporting housing, the collar includes a surface abutting an outer surface of the self-supporting housing thereby preventing the first tubular element from moving in a second direction along the through hole axis relative to the ornamental component.

10. An ornamental component according to claim 1, wherein the engagement portion of the locking element is inserted into the first tubular element and the through hole of the locking element and the through hole of the first tubular element together form the through hole of the ornamental component.

11. An ornamental component according to claim 1, wherein the first tubular element is part of an insert assembly inserted in the through hole of the self-supporting housing through the first opening of the self-supporting housing, the insert assembly is assembled from the first tubular element and a gripping element for frictionally gripping a part of the jewelry item, wherein the first tubular element is configured to secure the gripping element inside the through hole of the ornamental component.

12. A method for manufacturing an ornamental component, the ornamental component having a through hole allowing the ornamental component to be strung on an elongated member of a jewelry item selected from the group consisting of a bracelet and a necklace, the though hole defining a through hole axis, the method comprising the steps:

providing a self-supporting housing, having an through hole, the through hole comprises a first opening at a first side of the self-supporting housing and a second opening at a second side of the self-supporting housing;

inserting through the first opening of the self-supporting housing a first tubular element having a through hole;

inserting through the second opening of the self-supporting housing a locking element, the locking having a through hole, the locking element having an engagement portion for being positioned inside the through hole of the self-supporting housing;

attaching the engagement portion of the locking element to the first tubular element; and inserting a second tubular element into the through hole of the self-supporting housing, either through the first opening or the second opening of the self-supporting housing wherein the inner surface of the through hole of the self-supporting housing is spaced apart from the second tubular element and the first tubular element and the engagement portion of the locking element are inserted into the second tubular element.

13. A method according to claim 12, wherein the engagement portion is attached to the tubular element by a male/female locking mechanism wherein the male part comprises a protruding portion and the female part comprises a void, the void being at least one item selected from the group consisting of a recess and an opening.

14. A method according to claim 13, wherein the male part comprises a plurality of protruding portions and the female part comprises a plurality of voids.

15. A method according to claim 13, wherein the male/female locking mechanism is of the snap lock type wherein a movement from a free configuration of the male and female part to a locked configuration of the male and female part requires less force than a movement from the locked configuration of the male and female part to the free configuration of the male and female part.

16. A method according to claim 15, wherein the male part comprises a flexible member configured to deform from a first shape to a second shape when the male part comes into contact with the female part, and further to snap back into approximately the first shape when the flexible member is aligned with the void of the female part, whereby the flexible member engages with the void and locks the male part to the female part, and wherein the locking element is attached to the first tubular element by a pure translation between the two.

17. A method according to claim 13, wherein the male/female locking mechanism is of the rotational lock type, wherein the void is configured to allow the protruding portion of the male part to translate inside the void along the through hole axis when the locking element is in a free rotational orientation relative to the first tubular element, and to be prevented from moving in at least a first direction along the through hole axis when the locking element is in a locked position relative to the first tubular element and the locking element is in a locked rotational orientation relative to the first tubular element.

18. A method according to claim 12, wherein the first tubular element is part of an insert assembly inserted in the through hole of the self-supporting housing through the first opening of the self-supporting housing, the insert assembly is assembled from the first tubular element and a gripping element for frictionally gripping a part of the jewelry item, wherein the first tubular element is configured to secure the gripping element inside the through hole of the ornamental component.

* * * * *